US005474434A

United States Patent [19]

Wada et al.

[11] Patent Number: 5,474,434

[45] Date of Patent: Dec. 12, 1995

[54] SCROLL-TYPE COMPRESSOR HAVING RADIAL SCROLL CLEARANCE DURING REVERSE ROTATION AND IMPROPER ASSEMBLY PREVENTION

[75] Inventors: Katsuyoshi Wada; Tatsuya Sugita; Masaji Hagiwara; Minoru Ishii; Hiroshi Ogawa; Kiyoharu Ikeda, all of Shizuoka, Japan

[73] Assignee: Mitsubishi Denki Kabushiki Kaisha, Tokyo, Japan

[21] Appl. No.: 410,761

[22] Filed: Mar. 27, 1995

Related U.S. Application Data

[62] Division of Ser. No. 108,564, Dec. 6, 1993, now Pat. No. 5,447,419.

[30] Foreign Application Priority Data

Dec. 27, 1991 [JP] Japan ..... 3-107966
Dec. 16, 1992 [JP] Japan ..... 4-336002

[51] Int. Cl.[6] ..... F04C 18/04

[52] U.S. Cl. ..... 418/55.5; 418/57

[58] Field of Search ..... 418/55.5, 57; 29/888.022

[56] References Cited

U.S. PATENT DOCUMENTS 5,017,107 5/1991 Fraser, Jr. et al. ..... 418/55.5
5,199,862 4/1993 Kondo et al. ..... 418/55.5

*Primary Examiner*—John J. Vrablik
*Attorney, Agent, or Firm*—Oblon, Spivak, McClelland, Maier, & Neustadt

[57] ABSTRACT

A reliable scroll-type compressor is provided which, even when the compressor is rotated in the reverse direction by the erroneous connection of the power source terminals for example, it prevented from establishing a vacuum state within the compression chamber and no damages occur in the addendum of the stationary scroll and the orbiting scroll. Since the sliding surface of the slider is arranged to have an angle so that the slider is moved therealong in the direction in which the revolution radius of the orbiting scroll of the compressor is decreased, a clearance is generated between the stationary scroll and the orbiting scroll upon the reverse rotation.

4 Claims, 19 Drawing Sheets

SCROLL-TYPE COMPRESSOR HAVING RADIAL SCROLL CLEARANCE DURING REVERSE ROTATION AND IMPROPER ASSEMBLY PREVENTION

This is a division of application Ser. No. 08/108,564 filed on Dec. 6, 1993 now Pat. No. 5,447,419.

TECHNICAL FIELD

This invention relates to a scroll-type compressor and, more particularly, to a scroll-type compressor which is not damaged even when rotated in the reverse direction.

BACKGROUND ART

FIGS. 18 to 20 are sectional views of the main portion of a conventional scroll-type compressor of a first type disclosed for example in Japanese Patent Laid-Open No. 59-120794, in which 1 is a stationary scroll, 2 is an orbiting scroll defining a compression chamber together with the stationary scroll 1, 23 is a thrust surface of the orbiting scroll 2 at the side opposite to the compression chamber, 24 is an orbiting shaft disposed at the center of the thrust surface 23, 3 is a frame journaling the thrust surface 23 of the orbiting scroll 2, 5 is a main shaft for transmitting a drive force to the orbiting scroll 2, 27 is a motor for driving the main shaft 5, 7 is a slider rotatably accommodated within the orbiting bearing, 31 is a point of contact at which the stationary scroll 1 and the orbiting scroll 2 contact, 8 is a discharge valve disposed at a position for discharging the refrigerant, 21*a* is a load direction surface of a slider sliding surface and 21*b* is a non-load direction surface of the slider sliding surface.

The operation will now be described. The drive force of the motor 27 is transmitted to the main shaft 5, the slider 7 is rotated by the rotation of the main shaft 5 while maintaining a constant revolution radius r and is slidable along the contact surface between the slider 7 and the main shaft 5, so that the rotation of the slider 7 causes the orbiting scroll 2 to repeat orbiting motion at a constant revolution radius r, whereby a volume defined between the stationary scroll 1 and the orbiting scroll 2 decreases to compress the refrigerant which is then discharged from the discharge valve 8. The discharge valve 8 also functions as a check valve.

In FIG. 19, a resultant force F of a centrifugal force Fc on the slider 7 and a gas load force Fg generated by the compression acts on the slider 7, so that the slider 7 is moved along the sliding surface 21 in the direction along which the revolution radius is increased to urge the orbiting scroll 2 against the stationary scroll 1, whereby no clearance is generated at the point of contact 31 between the orbiting scroll 2 and the stationary scroll 1 and a compression with only a small leakage can be achieved.

FIG. 21 is a longitudinal sectional view illustrating the conventional scroll-type compressor of the second type disclosed in Japanese Patent Application No. 2-29127 filed previously by the applicant of the present application and FIG. 22 is a sectional view of the main portion of the structure shown in FIG. 21 and illustrating forces acting upon the main portion during the motor forward rotation. In FIG. 21, 1 is a stationary scroll, 2 is an orbiting scroll, 2*a* is a base plate for the orbiting scroll 2, 2*b* is an orbiting bearing disposed on the base plate 2*a* at the center of the non-compression chamber side, 3 is a frame fixed to the stationary scroll 1 by means of a bolt or the like, 4 is a ring-shaped Oldham's ring for preventing spinning of the orbiting scroll 1 and for connecting it to the frame 3 for the revolution movement in the radial direction, 5 is a main shaft having formed at its top end an eccentric slider mounting shaft 6 having a flat surface 6*a* and a flat surface 6*b* parallel to the axis of the main shaft 5, the slider mounting shaft 6 having mounted thereon a slider 7 so that it is not rotatable but slidable along a plane perpendicular to the axis of the main shaft 5 and it is fitted by the orbiting bearing 2b in an eccentric state relative to the axis of the main shaft 5. 8 is a discharge valve which also functions as a check valve.

Also, in FIG. 22, 7*a* is a fitting hole formed in the slider 7 for receiving the slider mounting shaft 6 wherein, 7*b* is a sliding surface of the slider 7 and 7*c* is an opposite sliding surface r is an eccentricity amount or a distance between the axis of the main shaft 5 (the center of the stationary scroll 1) and the axis of the orbiting bearing 2*b* (the center of the orbiting scroll 2 and also the center of the slider 7), and $r_1$ is an eccentricity amount when the scroll of the orbiting scroll 2 is in contact in radial direction with the scroll of the stationary scroll 1. Fca is a centrifugal force of the orbiting scroll 2 and the slider 7 generated when the orbiting scroll 2 is in the revolution movement, which acts along the line connecting the center of the main shaft 5 and the center of the slider 7, Fga is a compression load acting on the orbiting scroll 2 in the direction perpendicular to the centrifugal force Fca, Fra is an compression load acting on the orbiting scroll 2 in the direction opposite to the centrifugal force Fca, Fna and μ a are contact force and coefficient of friction between the sliding surface 7*b* of the slider 7 and the flat surface 6*a* of the slider mounting shaft 6. α is an angle defined between the sliding direction of the slider 7 and Fca or the direction of eccentricity, Which is shifted in the direction opposite to the direction Of rotation of the main shaft 5 relative to the direction of Fca and which is referred to as an inclination angle. Here, the sliding direction of the slider 7 refers to the direction of movement of the slider 7 for increasing the the eccentricity amount r or the direction of movement direction for urging the scrolls. Basically, the centrifugal force Fca acts on the center of the gravity, and Fga and Fra act on the midpoint between the axes of the main shaft 5 and the orbiting bearing 2*b*. However, the moment due to the positional displacement of these forces is restricted by the Oldham's ring 4 and the reaction from the Oldham's ring 4 is made not to be introduced into this system, so that these forces are deemed to act on the axis of the orbiting bearing 2*b* or the center of the slider 7.

The operation will now be described. When the power source terminals are correctly connected and the motor and the main shaft 5 are rotated in forward direction, the orbiting scroll 2 makes a revolution motion about the axis of the main shaft 5 as it is being guided by the Oldham's ring 4, decreasing the volume of the compression chamber defined between the coupled scrolls 2 and 1, whereby the refrigerant is compressed and discharged from the central compression chamber through the discharge valve 8.

During the forward rotation, as illustrated in FIG. 22, the sliding-direction component of the resultant force of the centrifugal force Fca and the compression loads Fga, Fra is greater than the frictional force μ aFna (which varies in direction by 180° according to the direction of movement of the slider 7) between the sliding surface 7*b* of the slider 7 and the flat surface 6*a* of the slider mounting shaft 6, so that $$\mu aFna<(Fca-Fra)\cos\alpha+Fga\sin\alpha \quad (1)$$

is satisfied, and the slider 7 is displaced in sliding direction to the position at which the orbiting scroll 2 is brought into contact with the stationary scroll 1 or to the eccentricity amount $r_1$ which is determined by both the scrolls to urge the orbiting scroll 2 against the stationary scroll 1, whereby the clearance or gap in the radial direction between the scrolls is made zero and the compression can be achieved. Also, since the slider 7 is slidable along the sliding direction in either direction beyond the state where it is moved to the eccentricity amount $r_1$, it can slide until both of the scrolls are brought into contact even when the configuration of the scrolls of the stationary scroll 1 and the orbiting scrolls is different from the predetermined one complete dimensions, the radial clearance during revolution can be always maintained at zero.

Also, when the motor and the main shaft 5 rotate in the reverse direction by, for example, the incorrect connection of the power source terminals, forces illustrated in FIG. 23 are generated. During the reverse rotation, the volume of the compression chamber increases, so that the pressure within the central compression chamber decreases and the discharge valve 8 is closed to function as a check valve, whereupon no refrigerant flows in the reverse direction.

Therefore, the suction pressure (the balanced pressure before the operation) outside of the compression chamber becomes higher than the pressure within the compression chamber which has increasing inner volume, so that the directions of the compression loads Fgb and Fra shift by 180° relative to those obtained during the forward rotation. In FIG. 23, although the inclination angle a is formed in the direction of rotation of the main shaft 5, its amount does not change as compared to that obtained during the forward rotation, or when only an angle corresponding to a small clearance necessary for fitting of the slider mounting shaft 6 into the slider fitting hole 7*a* is added to the inclination angle α, $$(Fca+Frb)\cos\alpha-\mu bFnb>Fgb\sin\alpha \quad (2)$$

Fcb: centrifugal force upon reverse rotation (Fcb =Fca)

Fgb: compression load acting perpendicular to centrifugal force Fcb upon reverse rotation Frb: compression load acting oppositely to centrifugal force Fcb upon reverse rotation Fnb, μb: contacting force and frictional coefficient between opposite sliding surface 7*c* and flat surface 6*b*, respectively stands, wherein the slider 7 moves in the sliding direction similarly in the forward rotation state to urge the orbiting scroll 2 against the stationary scroll 1, making the radial clearance zero and rotating in the reverse direction.

FIG. 24 shows a conventional scroll-type compressor of the third type add FIGS. 25 and 26 are detailed views of the related parts of a gear pump 9.

A pump case 9*a* has in its lower half a space containing an inner gear 9*b* having formed gear teeth in the outer side surface and an outer gear 9*c* having gear teeth engaging the teeth of the inner gear 9*b* formed in the outer side surface, and the pump case 9*a* has in its upper half a bore for allowing a pump drive portion 5*d* disposed at the lower end of the main shaft 5 to extend there through.

The gaps defined between the inner gear 9*b* and the outer gear 9*c* are generally separated by gear teeth into three gap spaces, i.e. a gap space 9*h*, a gap space 9*i* and a gap space 9*j*, which successively shift in the direction of rotation upon the rotation of the gears.

A pump port 9*d* is provided with an oil suction port 9*e* and an oil discharge port 9*f* and an oil suction pipe 9*g* is attached in communication to the lower through hole of the oil suction port 9*e*. The gap space 9*h* is in communication with the oil suction port 9*e*, the gap space 9*j* is in communication with the oil discharge port 9*f* and the gap space 9*i* is not communicated with any of the ports. The pump case 9*a* and the pump port 9*d* are securely accommodated within a sub-frame 11.

In FIGS. 24 to 26, the forward rotation (counterclockwise rotation in FIG. 26) of the main shaft 5 causes the inner gear 9*b* to be driven in the counterclockwise direction, and the outer gear 9*c* in mesh with the inner gear 9*b* through the gear teeth is also driven in the counterclockwise direction. By the counterclockwise rotation of these gears, the gap space 9*h* out of three gap spaces defined between the gears is increased in its inner volume, while the gap space 9*i* is at its maximum and the gap space 9*j* is decreased in its inner volume. Therefore, the lubricating oil staying at the bottom of the hermetic vessel 10 is suctioned into the volume-increasing gap space 9*h* through the oil suction pipe 9*g* and the oil suction port 9*e*. The lubricating oil is then supplied through the gap space 9*i* to the volume-decreasing gap space 9*j*. The lubricating oil is further discharged to the oil discharge port 9*f* due to the decrease of the inner volume of the gap space 9*j* and then supplied to each sliding portion of the compressor through the oil passage hole formed in the center of the main shaft 5.

Since the previously-described conventional scroll-type compressor of the first type is constructed as previously described, even when the compressor is reversely rotated by the incorrect connection of the power source terminals for example, the discharge valve prevents the reverse flow of the refrigerant and the slider moves in the direction in which the radius of revolution increases because of the resultant force F of the centrifugal force Fc and the gas load Fg shown in FIG. 20, so that there is no refrigerant leakage and the stationary scroll and the orbiting scroll compress the refrigerant only within the compression chamber to purge the refrigerant on the suction port side to make the compression chamber in a vacuum state. Therefore, the stationary scroll and the orbiting scroll are deformed and the teeth tips and the teeth bases are brought into abnormal contact, disadvantageously resulting in the damages of the addendum of the stationary scroll and the orbiting scroll.

In the conventional scroll-type compressor of the second type, in the event that the motor makes a reverse rotation due to the incorrect connection of the power terminals for example, the inner volume of the compression chamber increases with the radial clearance between the scrolls is zero and the discharge valve functions as a check valve which prevents the reverse flow of the refrigerant, the compression chambers less the most outside chamber is brought into a vacuum state after a continued reverse rotation to make a large axial deformation of the stationary scroll and the orbiting scroll which causes an abnormal contact between the teeth tips and the bases of the scrolls and damages in the addendum, resulting in an inoperable condition.

If the inclination angle α is made large, a relationship $$(Fcb+Frb)\cos\alpha+\mu bFnb<Fgb\sin\alpha \quad (3)$$

is established upon the reverse rotation, and the slider moves in the direction in which the eccentricity r of the orbiting scroll decreases and a radial clearance is formed between the scrolls whereby the vacuum condition can be relieved therethrough. However, upon the forward rotation, with the large inclination angle α, since the slider is moved in the sliding direction by a large force in accordance with the equation (1), the contacting force by which the scroll member of the orbiting scroll is Urged against the scroll member of the stationary scroll is increased and the friction therebetween causes the increase of mechanical loss, whereby the performance of the compressor is significantly degraded and, in the worst case, the scroll member of the stationary and orbiting scrolls are destroyed by the urging, contacting force.

As for the oil supply in the conventional scroll-type compressor of the third type, since the inner gear 9*b* and the outer gear 9*c* are driven in the clockwise direction in FIG. 25 during the reverse rotation, the volume of the previously discussed gap space 9*j* increases and the volume of the gap space 9*h* decreases. Therefore, the lubricating oil is introduced from the oil discharge port 9*f* communicated to the main shaft 5 into the oil suction port 9*e* communicated to the hermetic vessel 10 and the gear pump 11 fails: to achieve the function of supplying the lubricating oil staying at the bottom of the hermetic vessel 10 to each sliding portion of the compressor, whereby the sliding portion are disadvantageously run out of the lubricating oil and results in seizure of the sliding portion.

DISCLOSURE OF THE INVENTION

The present invention has been made in order to solve the above-discussed problems and has as its object the provision of a reliable scroll-type compressor which, even when the compressor is rotated in the reverse direction by the erroneous connection of the power source terminals for example, is prevented from establishing a vacuum state within the compression chamber and no damages occur in the addendum of the stationary scroll and the orbiting scroll.

Also, the object of the present invention is to provide a reliable scroll,type compressor which, when the compressor is rotated in the forward direction, achieves a highly efficient compression function without leakage by the urging of the orbiting scroll to the stationary scroll at an appropriate contact force and which, even upon the reverse rotation, ensures that lubricating oil is supplied to each sliding portion of the compressor to eliminate the fear of seizing of each sliding portion.

The scroll-type compressor of the present invention comprises a stationary scroll and an orbiting scroll having their scroll portions wound in the opposite direction combined to define therebetween a compression chamber, an orbiting shaft disposed at the central portion of the thrust surface of the orbiting scroll on the opposite side of the compression chamber, a frame for supporting the thrust surface of the orbiting scroll, a main shaft for transmitting a drive force to the orbiting scroll, a motor for driving the main shaft and a slider rotatably accommodated within the orbiting bearing, a sliding surface of the slider being arranged to have an angle so that the slider is moved therealong in the direction in which the revolution radius of the orbiting scroll during the reverse rotation of the compressor is decreased. According to this scroll-type compressor,i since the sliding surface of the slider is arranged to have an angle so that the slider is moved therealong in the direction in which the revolution radius of the orbiting scroll of the compressor is decreased, a clearance is generated between the stationary scroll and the orbiting scroll upon the reverse rotation.

Also according to the scroll-type compressor of the present invention, the clearance defined between the slider mounting shaft and the fitting hole of the slider is arranged so that the slider is moved in the direction in which the eccentricity of the orbiting scroll decreases upon the reverse rotation of the motor. In this scroll-type compressor, since the slider is moved in the direction in which the eccentricity of the orbiting scroll decreases upon the reverse rotation of the motor, a radial clearance is generated between the scrolls to enable the vacuum state therein to be relieved.

According to the present invention, the configuration of the slider and the slider mounting shaft or the main shaft can be made in such configuration that the slider cannot be assembled on the slider mounting shaft when it is rotated by 180°. IN this scroll-type compressor, the slider cannot be mounted to the slider mounting shaft when it is rotated by 180°, so that the direction of movement of the slider upon the motor reverse rotation is ensured to be in the direction along which the eccentricity of the orbiting scroll decreases and a radial Clearance between the scrolls is generated, enabling the vacuum state to be relieved.

In another scroll-type compressor, the angle of the sliding surface of the slider and the slider mounting shaft is selected so that the slider is moved in the direction in which the eccentricity of the orbiting scroll decreases upon the reverse rotation of the motor. In this scroll-type compressor, since slider is moved in the direction in which the eccentricity of the orbiting scroll decreases upon the reverse rotation of the motor, a radial clearance is generated between the scrolls and the vacuum state can be relieved.

According to the scroll-type compressor of the present invention, a stopper mechanism for restricting the sliding movement of the slider upon the reverse rotation of the motor may be mounted to,the slider and the slider mounting shaft. In this scroll-type compressor, since the slider is restricted with respect to the scroll member urging direction upon the reverse rotation of the motor, the scrolls can maintain a radial clearance therebetween and prevent the occurrence of the vacuum state.

The scroll-type compressor of the present invention also comprises a projection on the pump port and a 180° ring-shaped groove for engaging the projection in the pump case. According to this scroll-type compressor, the pump port alone rotates by 180° upon the reverse rotation of the motor, so that a gap space of which volume increases is communicated with the oil suction port upon the reverse rotation on one hand and a gap space of which volume decreases is communicated with the oil discharge port upon the forward rotation.

BEST MODE FOR WORKING THE INVENTION

Embodiment 1

Figure 1:
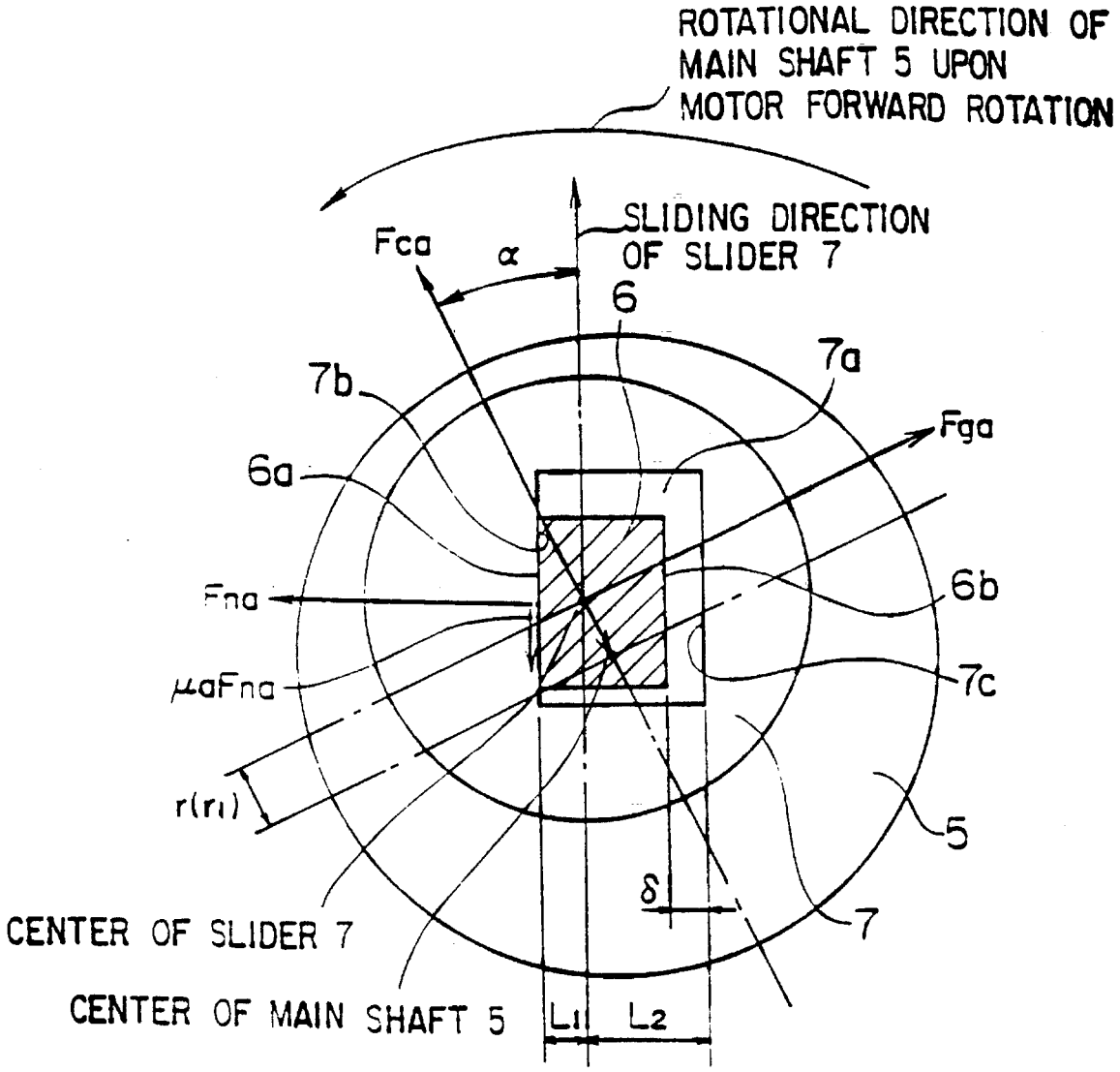
FIG. 1 is a force diagram illustrating a section of a main portion of the scroll-type compressor of the first embodiment of the present invention upon the forward rotation of the motor with various forces acting thereon indicated thereon.
Figure 2:
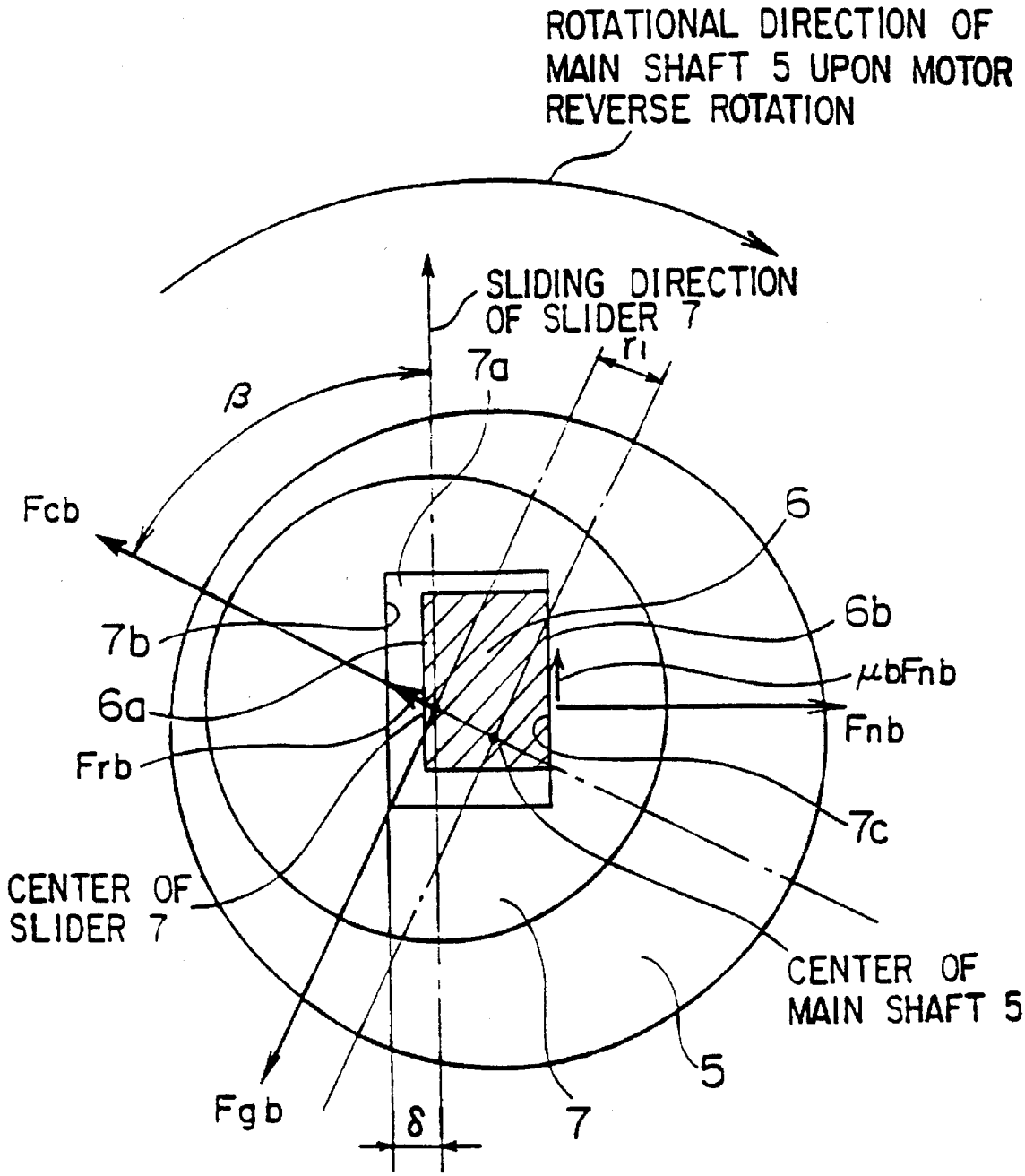
FIG. 2 is a force diagram illustrating a section of a main portion of the scroll-type compressor of the first embodiment of the present invention upon the reverse rotation of the motor with various forces acting thereon indicated thereon.

The embodiment 1 will now be described in conjunction with the drawings. FIG. 1 is a sectional view of the main portion when the motor is forwardly rotated and FIG. 2 is a sectional view of the main portion when the motor is reversely rotated, these ! figures illustrating the acting forces. Here, the components the same as or corresponding to those of the conventional design are designated by the identical reference characters and their explanations are omitted.

As shown in FIG. 1, the clearance between the slider mounting shaft 6 and the slider fitting hole 7*a* is arranged so that the inclination angle is $\alpha$ and a clearance $\delta$ is generated between the flat surface 6*b* of the slider mounting shaft 6 and the opposite sliding surface 7*c* of the slider 7 upon the forward rotation.

When the power source terminals are correctly connected and the main shaft 5 is rotated in the forward direction as shown in FIG. 1, the inclination angle becomes $\alpha$, so that, similarly to the conventional design, upon the forward rotation, $$\mu aFna<(Fca-Fra)\cos\alpha+Fga\sin\alpha \quad (1)$$

is satisfied, whereupon the slider 7 is displaced in the sliding direction to the position at which the orbiting scroll 2 is brought into contact with the stationary scroll 1, i.e., by a distance corresponding to the eccentricity $r_1$ determined by both the scrolls, the orbiting scroll 2 is urged against the stationary scroll 1 with an appropriate contact force to make the radial clearance between both the scrolls in the direction of eccentricity and the opposite direction of eccentricity zero, thus achieving the compression. Also, since the slider 7 can be slidable back and forth in the sliding direction beyond the position to which the slider 7 moves through the eccentricity $r_1$, the slider 7 slides until the scrolls are brought into contact with each other even when the shapes of the scroll members of the stationary scroll 1 and the orbiting scroll 2 are deformed from the predetermined dimensions, whereby the radial clearance during one rotation can always be made zero.

On the other hand, when the power source terminals are incorrectly connected and the motor drives the main shaft 2 in the reverse direction as shown in FIG. 2, the flat surface 6*b* of the slider mounting shaft 6 is brought into contact with the opposite sliding surface 7*c* of the slider 7 and a clearance $\delta$ is formed between the flat surface 6*a* and the sliding surface 7*b*. Therefore, the positional relationship between the slider 7 and the main shaft 5 to which the slider mounting shaft 7 is integrally formed is changed from that established upon the forward rotation, and the direction of the centrifugal force Fcb acting on the slider 7 and the orbiting scroll 2 and directed along the line passing through the center of the main shaft 5 and the center of the orbiting scroll 2 (the center of the slider 7) is larger in the angle (inclination angle) of the slider 7 relative to the sliding direction than the direction of the centrifugal force Fca upon the forward rotation, and the sliding direction of the slider 7 is inclined in the direction of rotation of the main shaft 5 relative to the direction of the centrifugal force Fcb contrary to the case of the forward rotation. When the inclination angle upon the reverse rotation is expressed by $\beta$, $\beta>\alpha$ stands, and when this $\beta$ satisfies $$(Fcb+Frb)\cos\beta-\mu bFnb<Fgb\sin\beta \quad (4),$$

the slider 7 moves in the direction in which the eccentricity r of the orbiting scroll 2 decreases, whereby a radial clearance is generated between the scrolls to relief the vacuum state therebetween. Therefore, by selecting the clearance δ between the flat surface 6*b* and the opposite sliding surface 7*c* upon the forward rotation so that β satisfies the above equation 4, a radial clearance is generated between the scrolls upon the reverse rotation.

Therefore, in the embodiment 1, since the clearance between the slider mounting shaft 6 and the slider fitting hole 7*a* is selected so that the inclination angle is a upon the forward rotation and is β which satisfies the equation 4 upon the reverse rotation, the slider 7 is moved in the direction in which, upon the forward rotation, the orbiting scroll 2 is urged against the stationary scroll 1 with-an appropriate contact force, so that the radial clearance between the scrolls becomes zero and a highly efficient compression without any leakage can be achieved and in which, upon the reverse rotation, the eccentricity r of the orbiting scroll 2 decreases and a radial clearance is generated between the scrolls to enable the vacuum state within the compression chamber is relieved.

Embodiment 2

Figure 3:
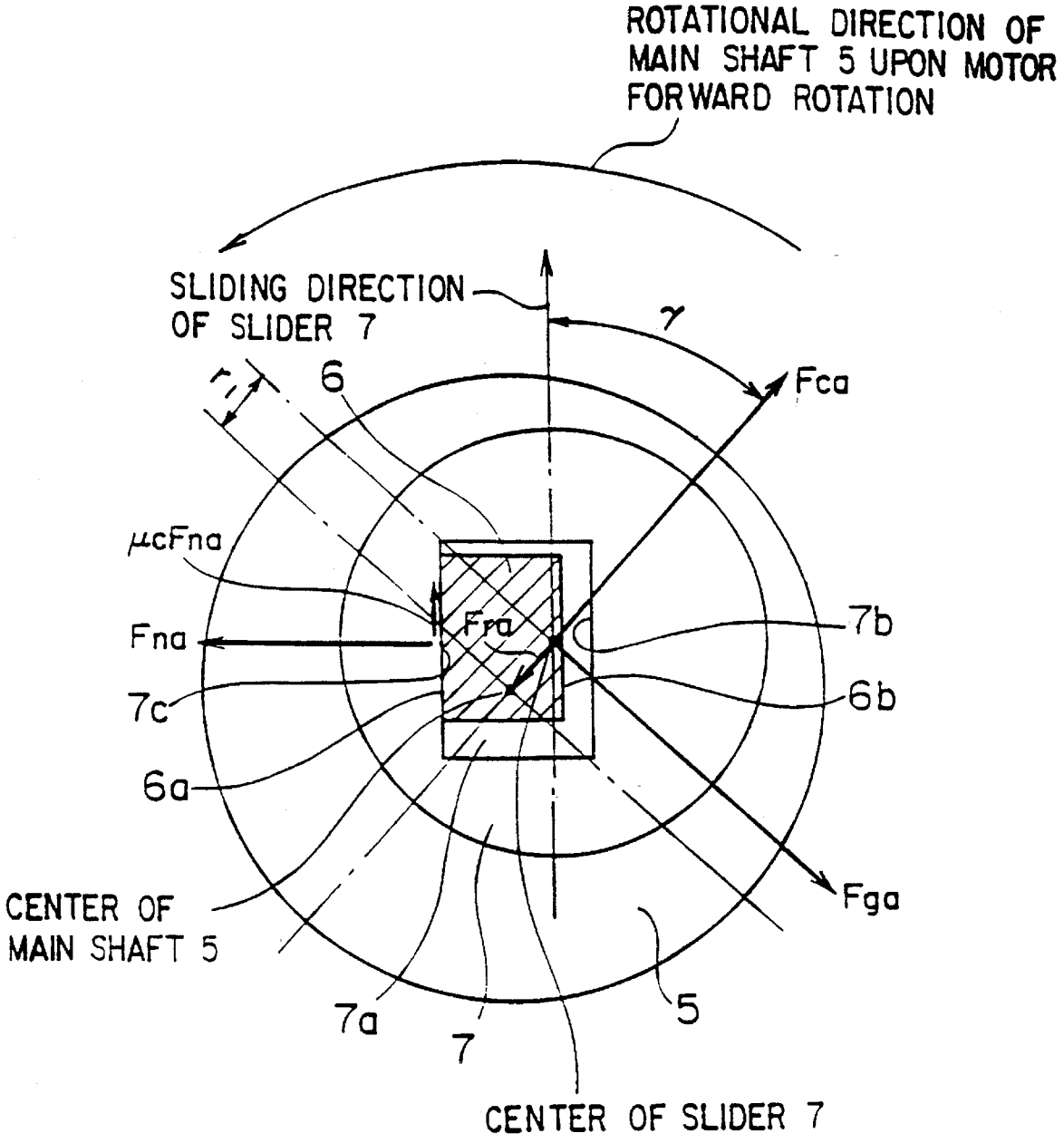
FIG. 3 is a force diagram when the slider of the scroll-type compressor of the first embodiment of the present invention is assembled in a position shifted by 180° and the motor is rotated in the forward direction.

In embodiment 1, it is possible that the slider 7 is erroneously assembled in a position rotated by 180° because of its configuration. FIG. 3 illustrates the slider 7 of the embodiment 1 assembled in the position rotated by 180° together with various forces acting thereon.

When the machine rotates in the forward direction with the flat surface 6*a* and the opposite sliding surface 7*c* brought into contact as illustrated in FIG. 3, since the distance $L_2$ between the center line of the slider 7 and the opposite sliding surface 7*c* is greater than the distance $L_1$ between the center line of the slider 7 and the sliding surface 7*b* shown in FIG. 1, the inclination angle becomes δ which is greater than α depending upon the difference between $L_1$ and $L_2$ and the sliding direction of the slider 7 is tilted in the direction of rotation of the main shaft 5 relative to the direction of the centrifugal force Fca. This is a force-action condition similar to that of embodiment 2 upon the reverse rotation, in which, even when forwardly rotated when the difference between $L_1$ and $L_2$ is large, the relationship $$(Fca+Fra)\cos\gamma-\mu cFna<Fga\sin\gamma \quad \ldots (5)$$

where, μc: coefficient of friction between the flat surface 6*a* and the opposite sliding surface 7*c* stands, whereupon the slider 7 may be moved in the direction along which the eccentricity r of the orbiting scroll 2 decreases and a radial clearance may be generated between the scrolls, making the compression impossible.

Figure 4:
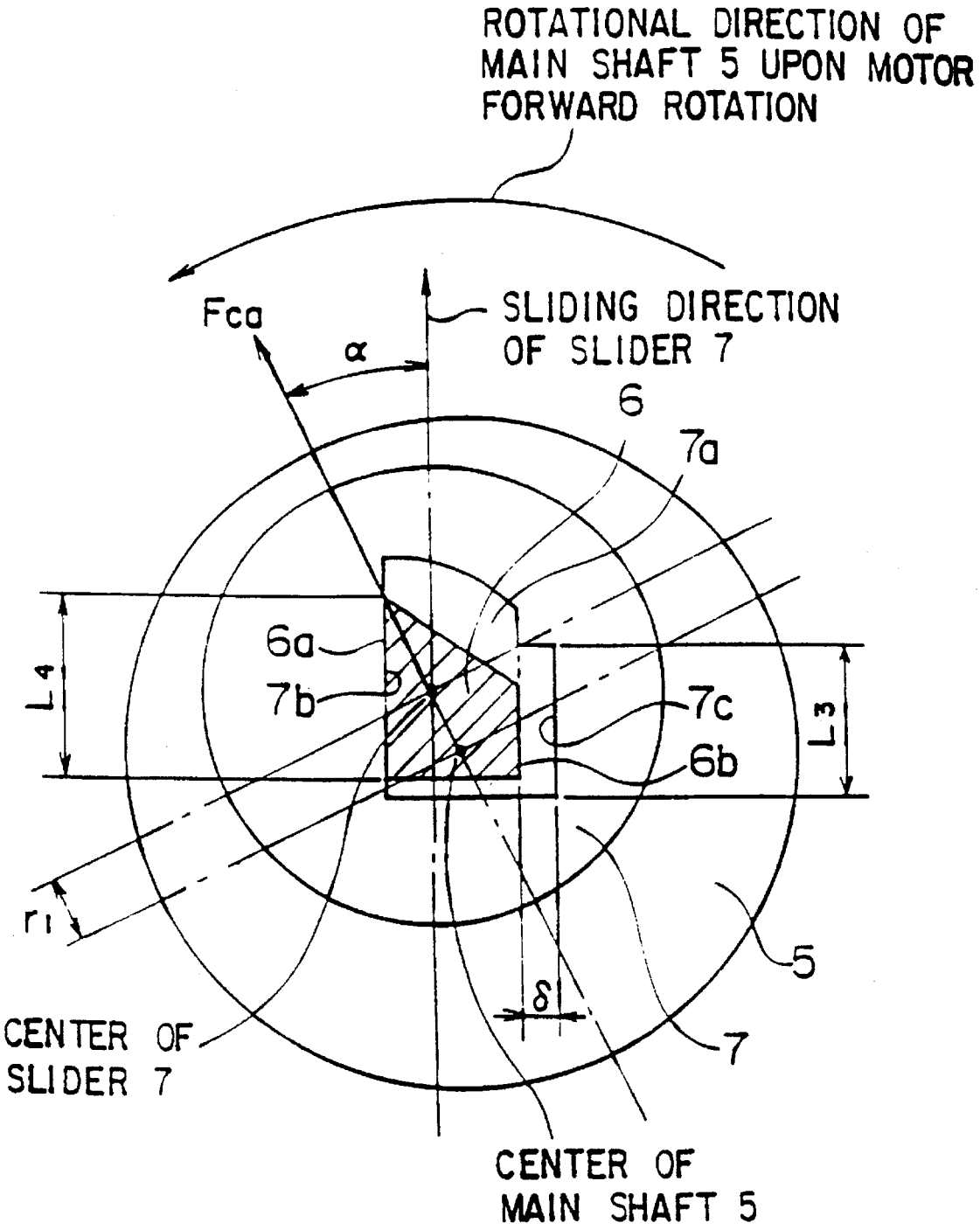
FIG. 4 is a sectional view of a main portion of the scroll-type compressor of the second embodiment of the present invention upon the forward rotation of the motor.

Therefore, embodiment 2 in which the above-discussed assembly error of the slider 7 can not take place will now be described. FIG. 4 is a sectional view of the main portion of the slider mounting shaft 6 and the slider 7 of embodiment 2 which are correctly assembled and rotated in the forward direction. As illustrated in FIG. 4, width $L_3$ of the fitting hole at a position shifted by δ toward the center from the opposite sliding surface 7*c* of the slider is smaller than width $L_4$ of the flat surface 6*a* of the slider mounting shaft 6. Also, similarly to embodiment 1, upon the forward rotation, the inclination angle is α and a clearance δ is generated between the flat surface 6*b* and the opposite sliding surface 7*c* . Since the arrangement is as above described in this embodiment 2, it is not possible to assemble the slider 7 in a position rotated by 180° because $L_3<L_4$, and, when rotated in the forward direction, the orbiting scroll 2 is urged to the stationary scroll 1 with an appropriate contacting force in a manner similar to embodiment 1 to make the radial clearance between the scrolls zero to achieve a highly efficient compression and, when rotated in the reverse direction, the slider 7 is moved in the direction along which the eccentricity r of the orbiting scroll 2 decreases to generate a radial clearance between the scrolls, enabling the vacuum state within the compression chamber to be relieved.

Embodiment 4

Figure 5:
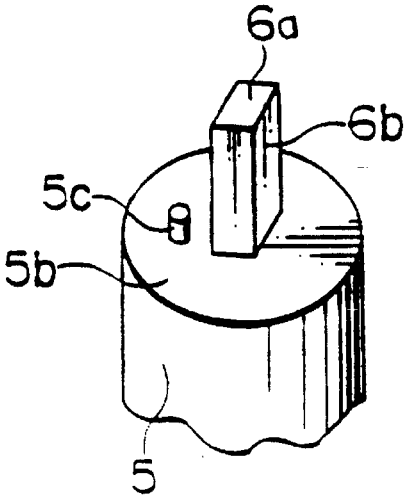
FIG. 5 is a perspective view of the main shaft of the scroll-type compressor of the third embodiment of the present invention.
Figure 6:
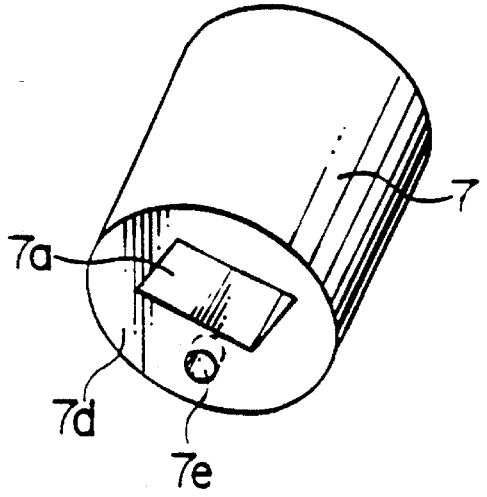
FIG. 6 is a perspective view of the slider of the scroll-type compressor of the third embodiment of the present invention.

FIG. 5 is a perspective view of the main shaft 5 of embodiment 3, and FIG. 6 is a perspective view of the slider 7 of the present embodiment.

Figure 7:
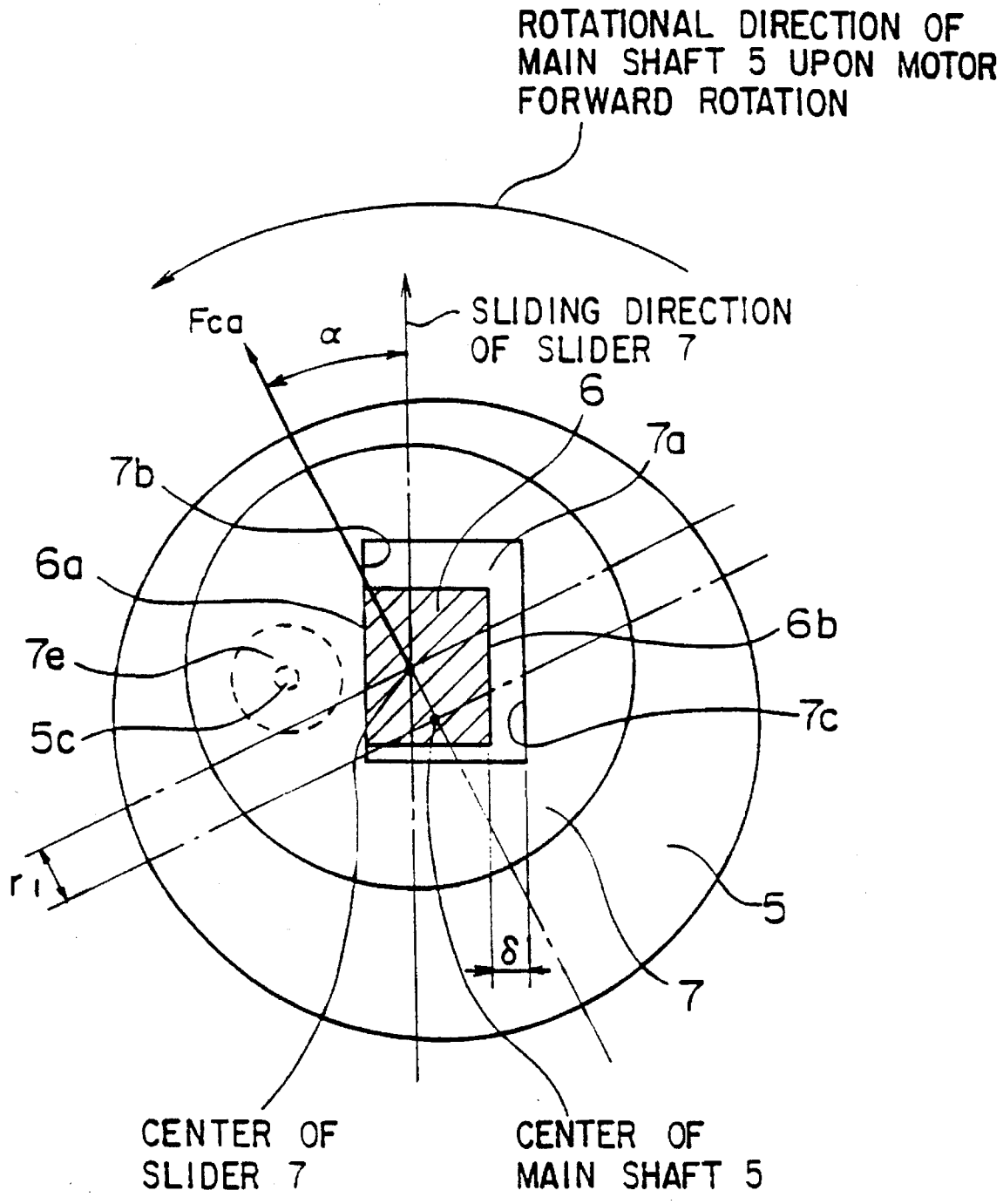
FIG. 7 is a sectional view of a main portion of the scroll-type compressor of the third embodiment of the present invention upon the forward rotation of the motor.

Also, FIG. 7 is a sectional view of the main portion of this embodiment when the slider 7 is correctly mounted on the slider mounting shaft 6 and forwardly rotated.

5*b* in FIG. 5 is a top end surface of the main shaft 5 and 5*c* is a projection portion disposed on the top end surface 5*b*, which may be integrally mounted on the main shaft or a pin or a bolt inserted into the top end surface.

7*d* in FIG. 6 is a bottom end surface of the slider 7 and 7*e* is a recessed portion formed in the bottom end surface 7*d*.

When the slider 7 is correctly assembled, the projection portion 5*c* is surrounded by the recessed portion 7*e* and the projection portion 5*c* and the recessed portion 7*e* are positioned such that the bottom end surface 7*d* is in parallel contact with the top end surface 5*b*. The size of the recessed portion 7*e* is such that it is not brought into contact with the projection portion 5*c* by any behaviour of the slider 7 during the operation (forward/reverse rotation). Similarly to embodiment 1, the inclination angle upon the forward rotation is α as shown in FIG. 7 and a clearance δ is generated between the flat surface 6*b* and the opposite sliding surface 7*c* . Since the construction is as above in this embodiment 4, when the slider 7 is tried to assemble in a position rotated by 180°, the positional relationship between the projection portion 5*c* and the recessed portion 7*e* is shifted by 180° and the projection portion 5*c* is brought into engagement with the bottom end surface 7*d*, whereby the slider 7 is placed in a position tilted relative to the top end surface 5*b* of the main shaft 5 so that the subsequent mounting of the orbiting scroll 2 is impossible.

During the forward rotation, similarly to embodiment 1, the orbiting scroll 2 is urged against the stationary scroll 1 with an appropriate contact force, making the radial clearance between the scrolls zero to achieve a highly efficient leak-free compression, and during the reverse rotation, the slider 7 is moved in the direction in which the eccentricity r of the orbiting scroll 2 decreases, generating a radial clearance between the scrolls, enabling the vacuum state within the compressions chamber to be relieved.

In the above embodiment 3, the positions of the projection portion 5*c* and the recessed portion 7*e* may be anywhere on the top end surface 5*b* or the bottom end surface 7*d* as long as they are in correspondence to each other, and the recessed portion 7*e* may be faced with the slider engagement hole 7*a* . Also, the projection portion 5*c* may be disposed on the bottom end surface 7*d* of the slider 7 and the recessed portion 7*e* may be disposed on the top end surface 5*b* of the main shaft 5 with similar advantageous effect.

Embodiment 4

Figure 8:
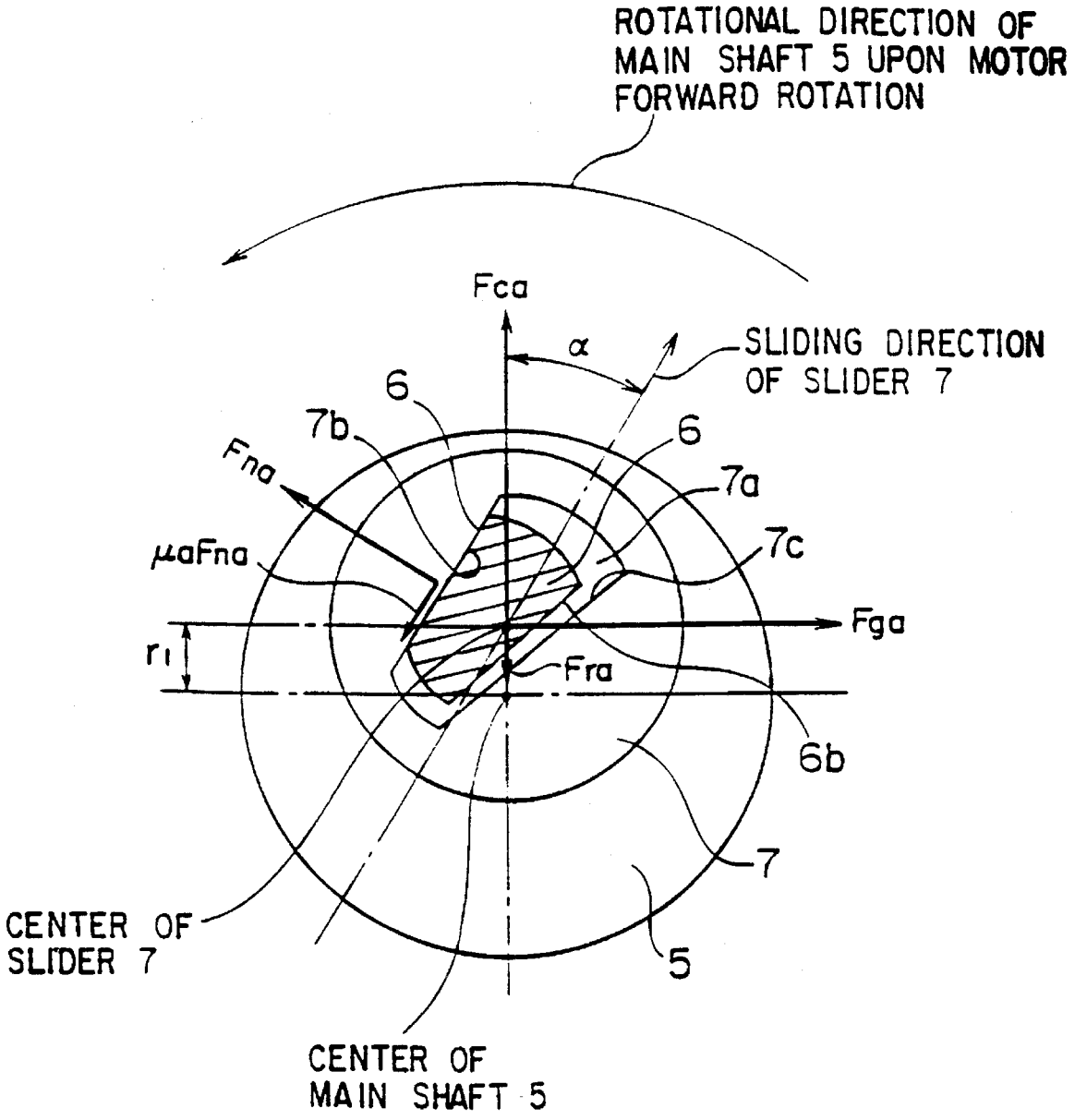
FIG. 8 is a force diagram illustrating a section of a main portion of the scroll-type compressor of the fourth embodiment of the present invention upon the forward rotation of the motor with various forces acting thereon indicated thereon.
Figure 9:
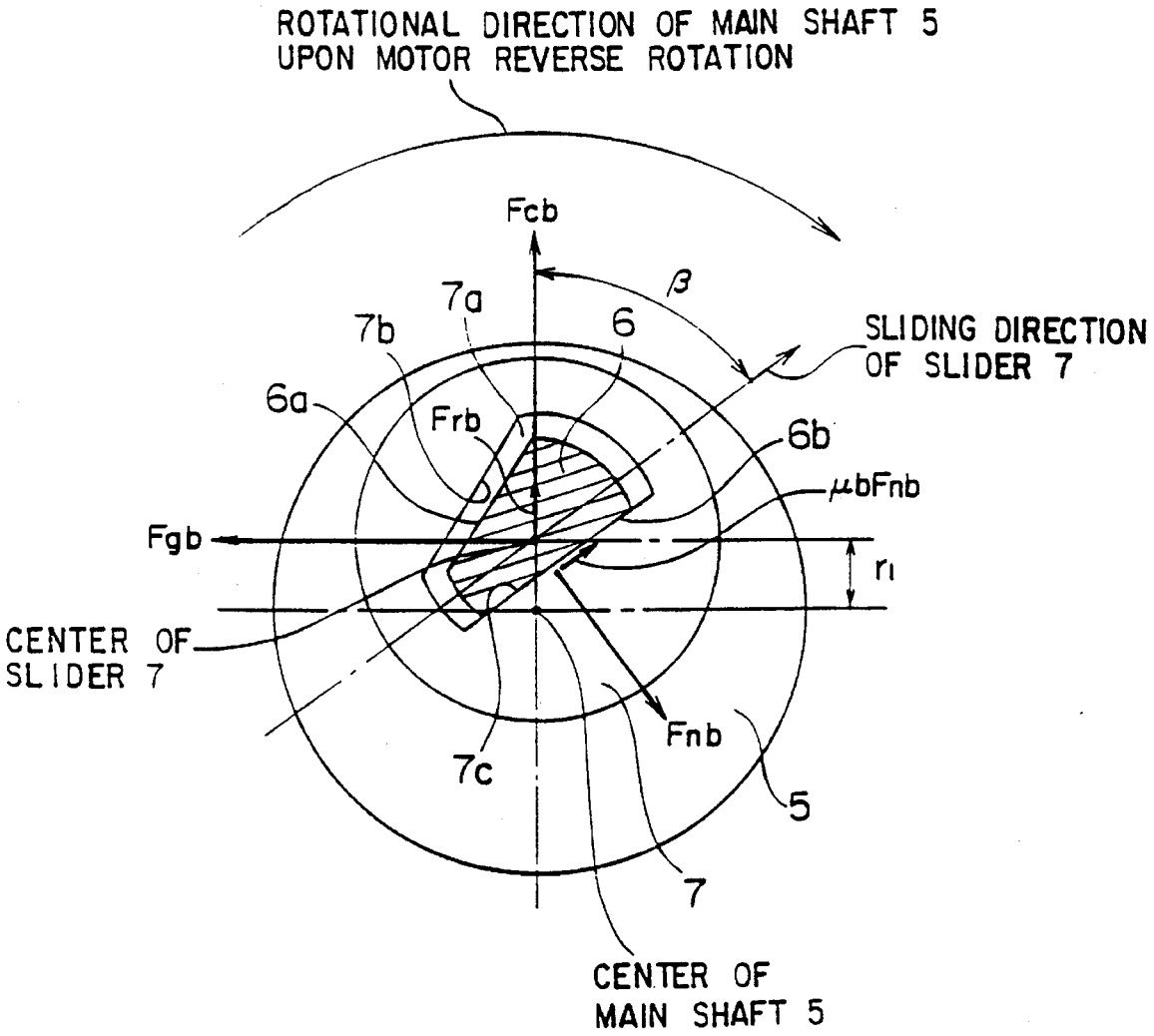
FIG. 9 is a force diagram illustrating a section of a main portion of the scroll-type compressor of the fourth embodiment of the present invention upon the reverse rotation of the motor with various forces acting thereon indicated thereon.

Next, embodiment 4 will now be described in connection with drawings. FIG. 8 is a sectional view of the main portion of this embodiment upon the forward rotation of the motor, FIG. 9 is a sectional view of the main portion of the embodiment upon the reverse rotation of the motor illustrating the acting forces.

Figure 19:
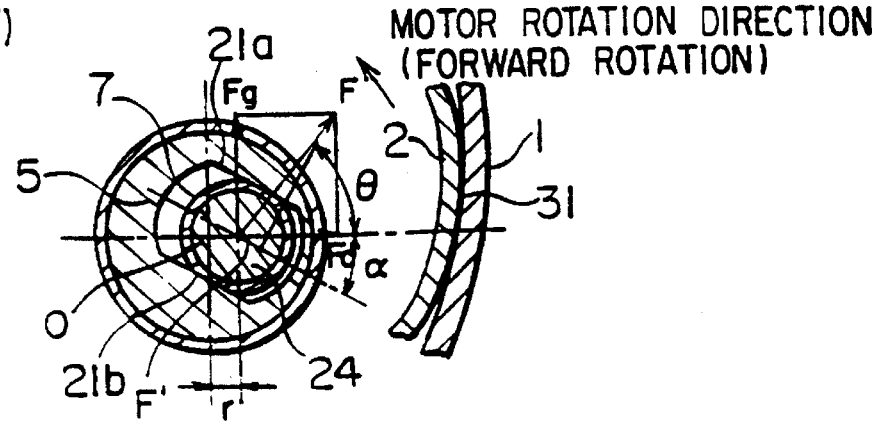
FIG. 19 (PRIOR ART)
FIG. 19 is a sectional view of the slider of the scroll-type compressor shown in FIG. 18 upon the forward rotation of the motor.
Figure 20:
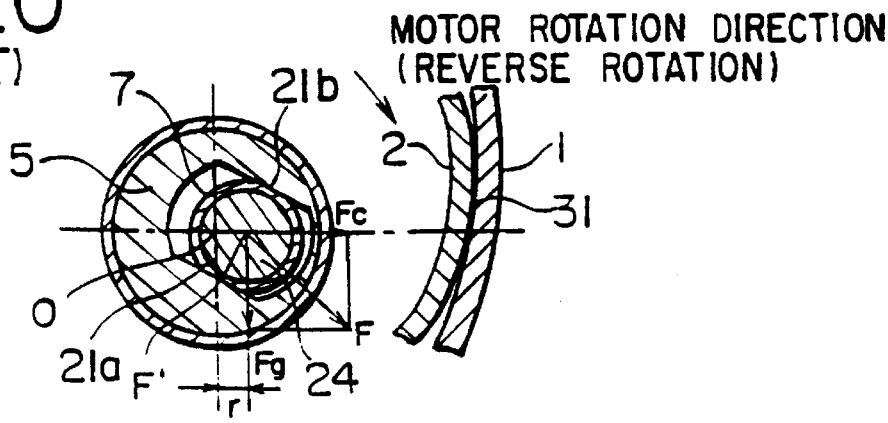
FIG. 20 (PRIOR ART)
FIG. 20 is a sectional view of the slider of the scroll-type compressor shown in FIG. 18 upon the reverse rotation of the motor.
Figure 21:
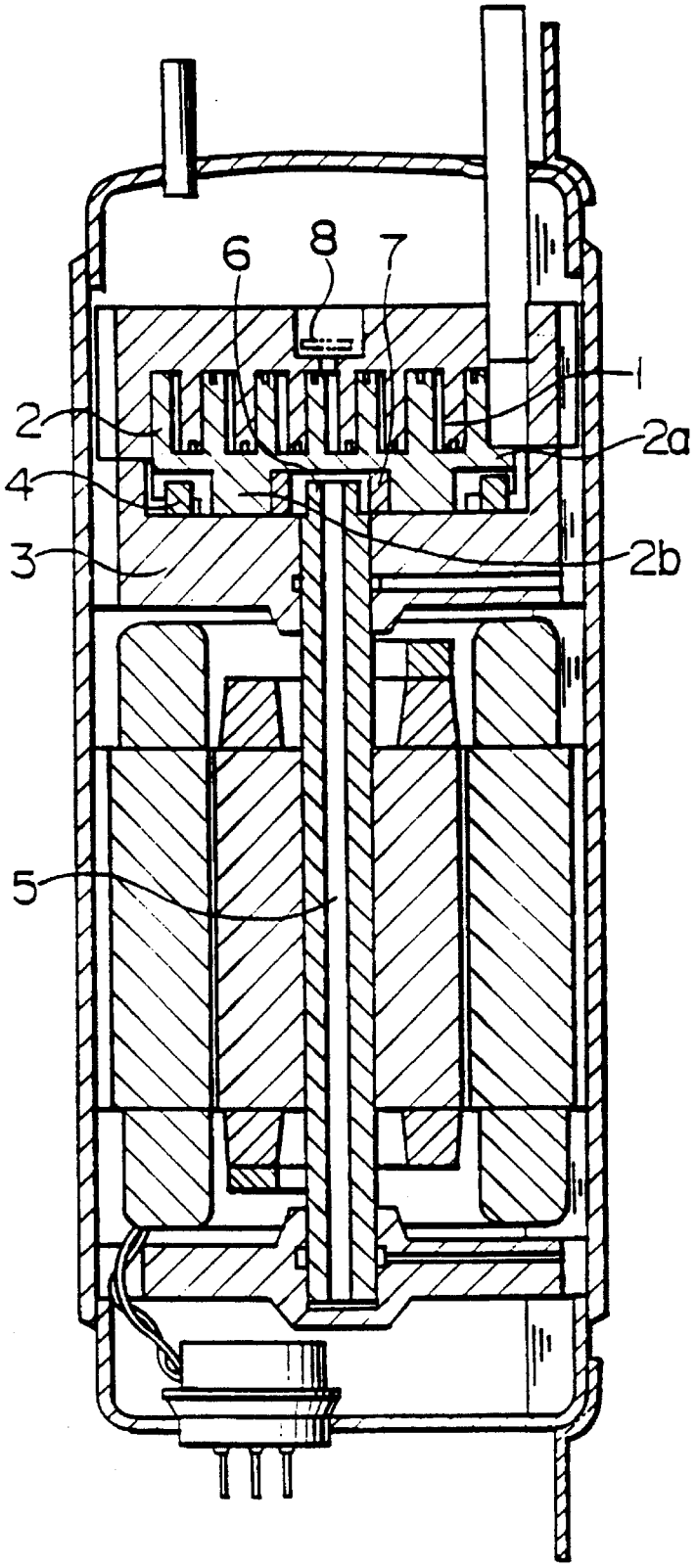
FIG. 21 (PRIOR ART)
FIG. 21 is a longitudinal sectional view of another convention scroll-type compressor.
Figure 22:
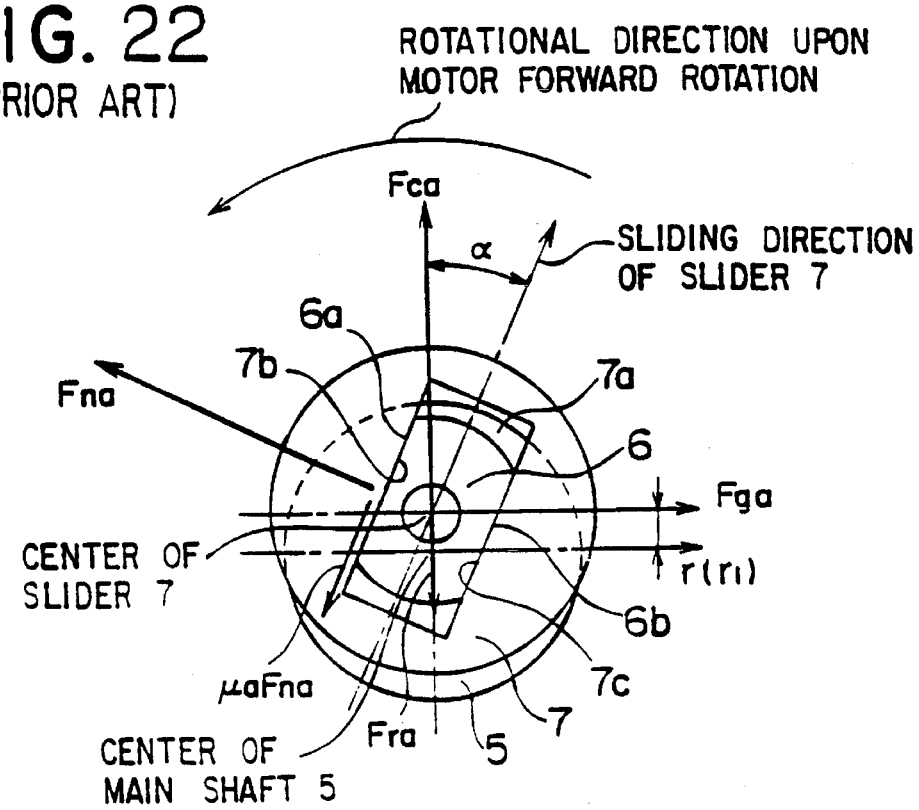
FIG. 22 (PRIOR ART)
FIG. 22 is a force diagram illustrating a section of a main portion of the conventional scroll-type compressor shown in FIG. 21 upon the forward rotation of the motor with various forces acting thereon indicated thereon.
Figure 23:
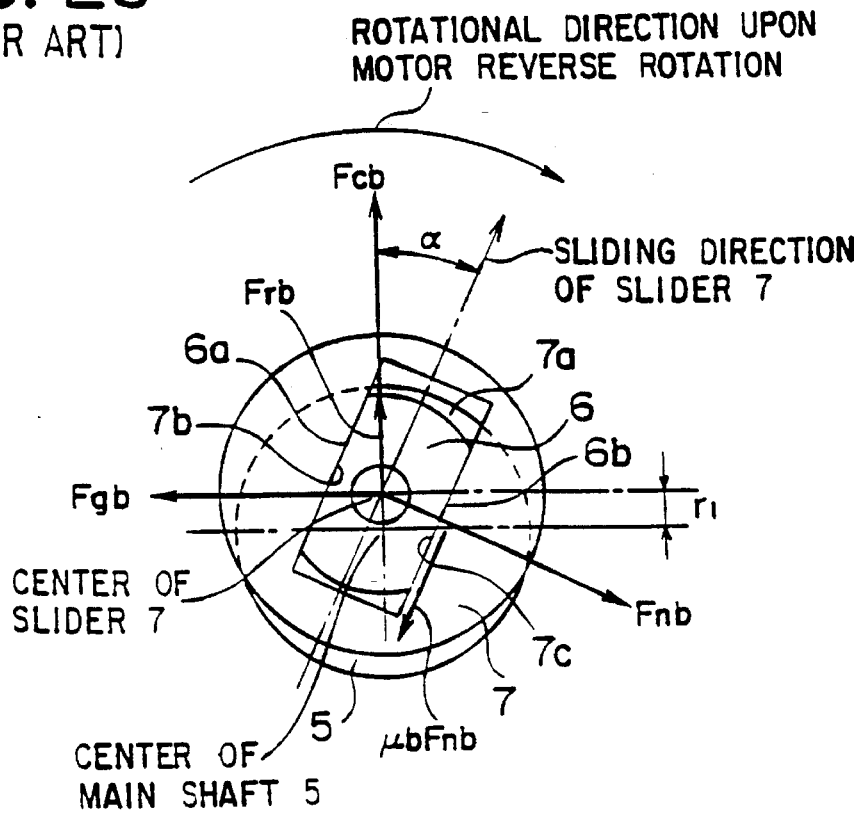
FIG. 23 (PRIOR ART)
FIG. 23 is a force diagram illustrating a section of a main portion of the conventional scroll-type compressor shown in FIG. 21 upon the reverse rotation of the motor with various forces acting thereon indicated thereon.

As shown in FIG. 8, the angle of the sliding surface 7*b* of the slider 7 and the flat surface 6*a* of the slider mounting shaft 6 is selected so that the inclination angle becomes α upon the forward rotation. Also, the angle of the opposite sliding surface 7*c* of the slider 7 and the flat surface 6*b* of the slider mounting shaft 6 is selected so that the inclination angle β upon the reverse rotation becomes, as shown in FIG. 19, $$(Fcb+Frb)\cos\beta-\mu bFnb<Fgb\sin\beta\ldots(4)$$

The slider mounting shaft 6 and the mounting hole 7*a* of the slider 7 have a clearance therebetween so that the slider 7 is movable into the sliding direction and the opposite-sliding direction.

Therefore, the sliding surface 7*b* and the opposite-sliding surface 7*c* of the slider 7 are not in parallel to each other and the width of the mounting hole 7*a* increases toward the sliding direction (as previously explained, the direction of movement along which the eccentricity r increases) of the slider 7. Similarly, the flat surface 6*a* and the flat surface 6*b* of the slider mounting shaft 6 are not parallel to each other and the width of the slider mounting shaft 6 increases toward the sliding direction of the slider 7.

Since the embodiment 4 is as above constructed, during the forward rotation of the motor, the inclination angle is α and the slider 7 is moved into the sliding direction to the position! where the orbiting scroll 2 is brought into contact with the stationary scroll 1, i.e., by a distance corresponding to the eccentricity r determined by the scrolls to urge the orbiting scroll 2 against the stationary scroll 1 with an appropriate contact force, whereby the radial clearance between both the scrolls in the direction of eccentricity and the opposite direction of eccentricity is made zero to achieve the compression. Also, since the slider 7 is further slidable back and forth in the sliding direction beyond the position where the slider 7 is moved by the eccentricity r, the slider 7 can slide until both the scrolls are brought into contact with each other even when the configurations of the scroll members of the stationary scroll 1 and the orbiting scroll 2 are different from the predetermined dimensions, so that the radial clearance during one rotation can always be made zero.

Upon the reverse rotation of the motor, the inclination angle is β and satisfies $$(Fcb+Frb)\cos\beta-\mu bFnb<Fgb\sin\beta\ldots(4)$$

so that the slider 7 is moved in the direction in which the eccentricity r of the orbiting scroll 2 decreases to generate a radial clearance between two scrolls and the vacuum state can be relieved. Also, since the mounting hole 7*a* and the slider 7 and the slider mounting shaft 6 have a wedge-shape, the slider 7 cannot be erroneously mounted at a 180° rotated position.

Embodiment 5

Figure 10:
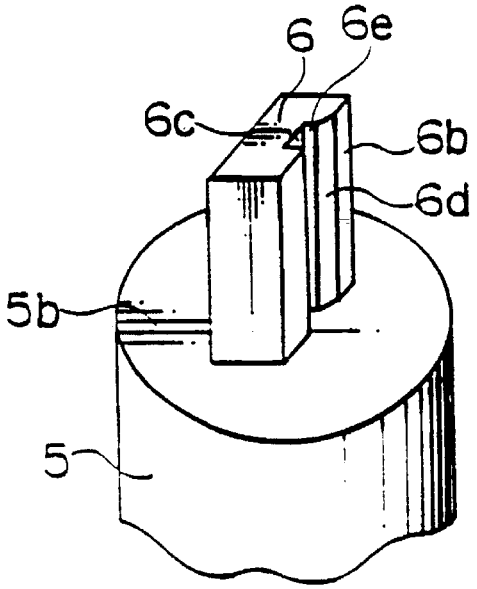
FIG. 10 is a perspective view of the slider mounting shaft of the scroll-type compressor of the fifth embodiment of the present invention.
Figure 11:
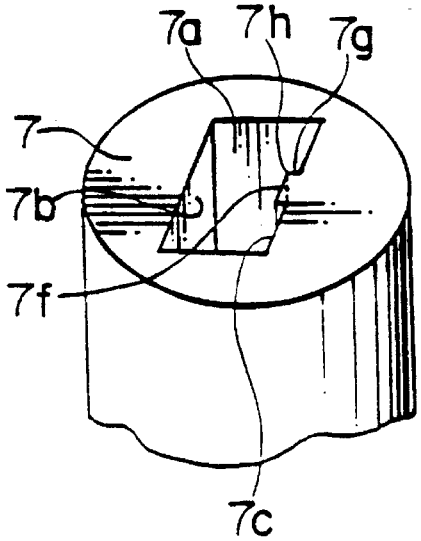
FIG. 11 is a perspective view of the slider of the scroll-type compressor of the fifth embodiment of the present invention.
Figure 12:
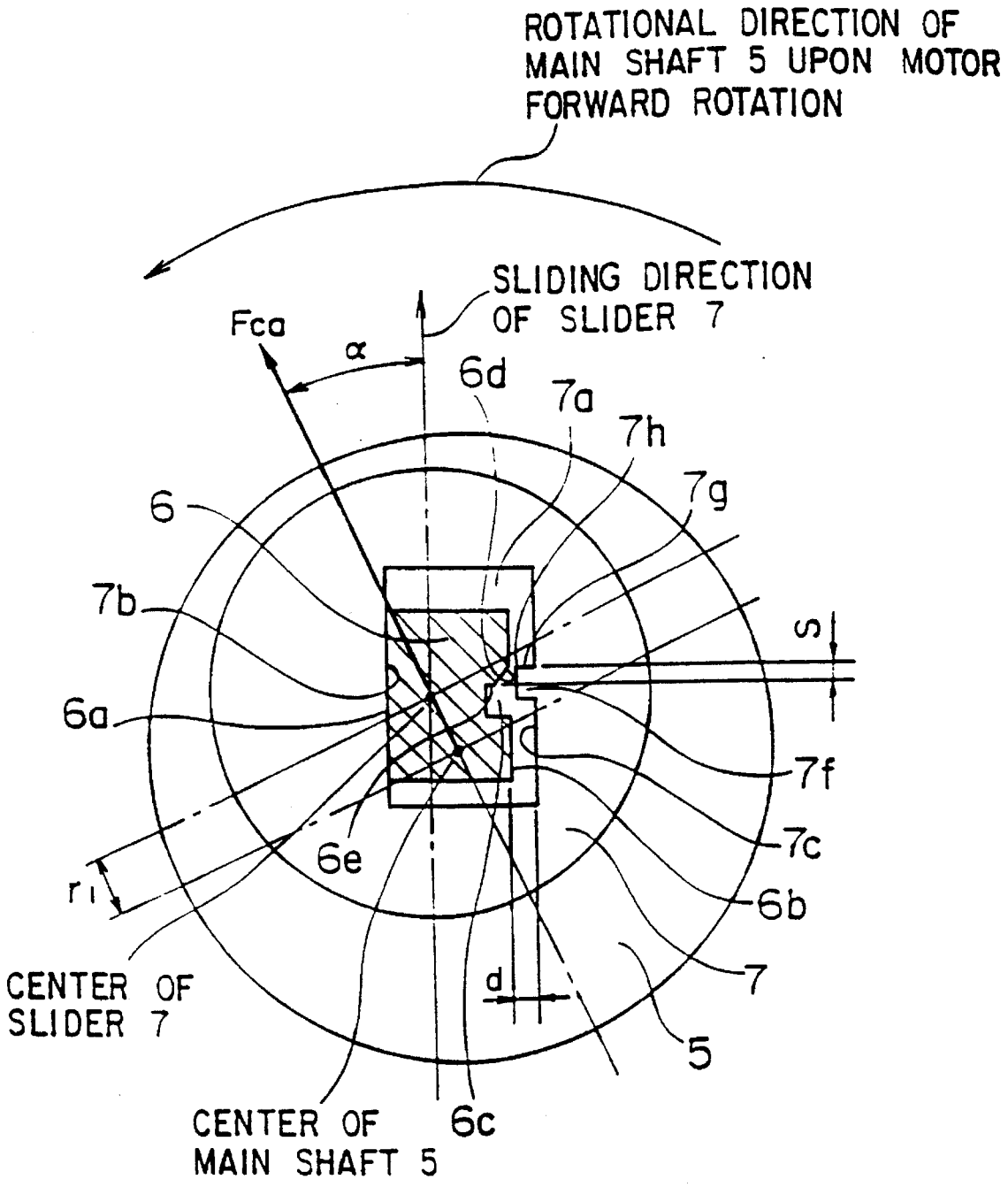
FIG. 12 is a sectional view of a main portion of the scroll-type compressor of the fifth embodiment of the present invention upon the forward rotation of the motor.
Figure 13:
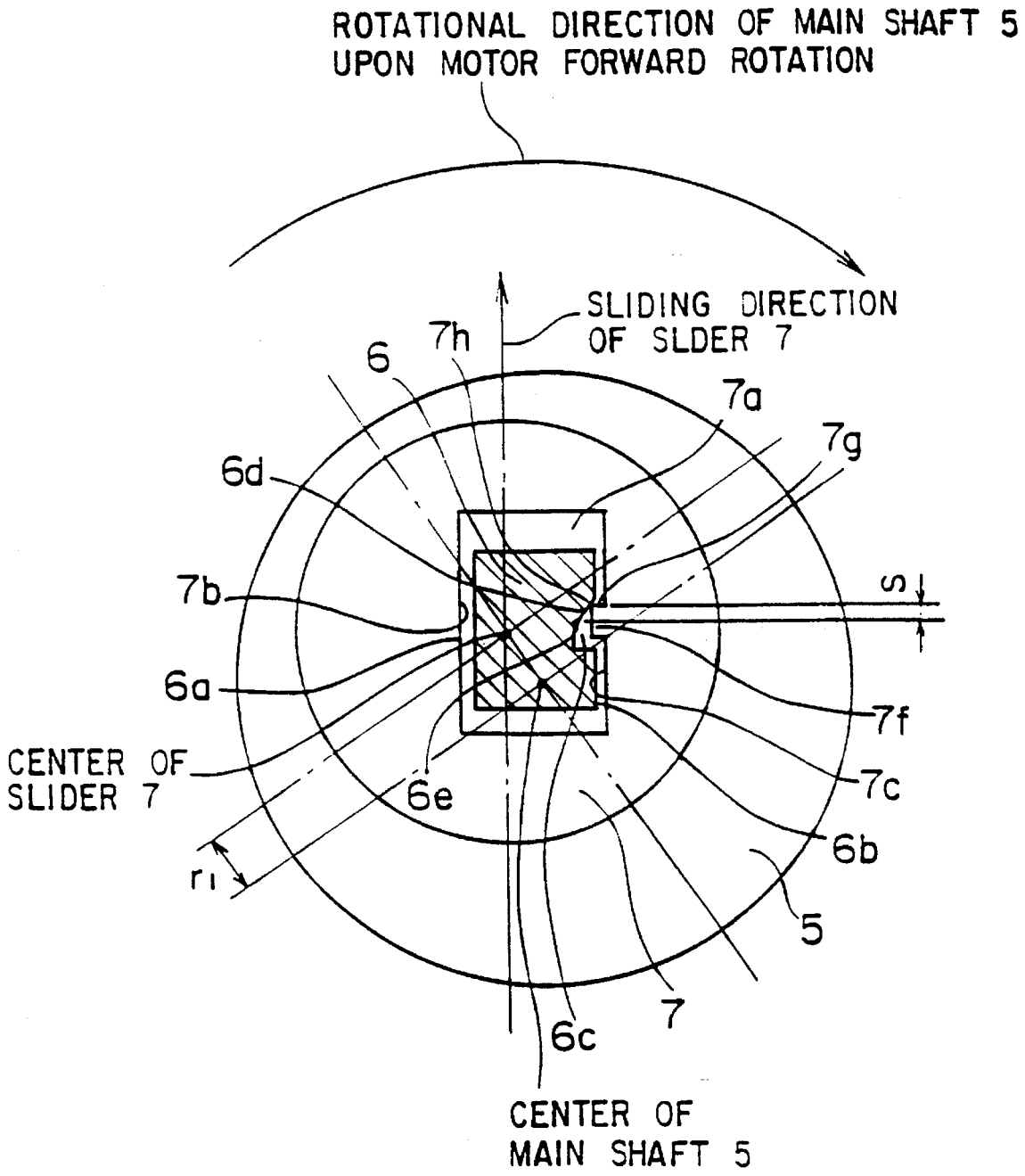
FIG. 13 is a sectional view of a main portion of the scroll-type compressor of the fifth embodiment of the present invention upon the reverse rotation of the motor.
Figure 14:
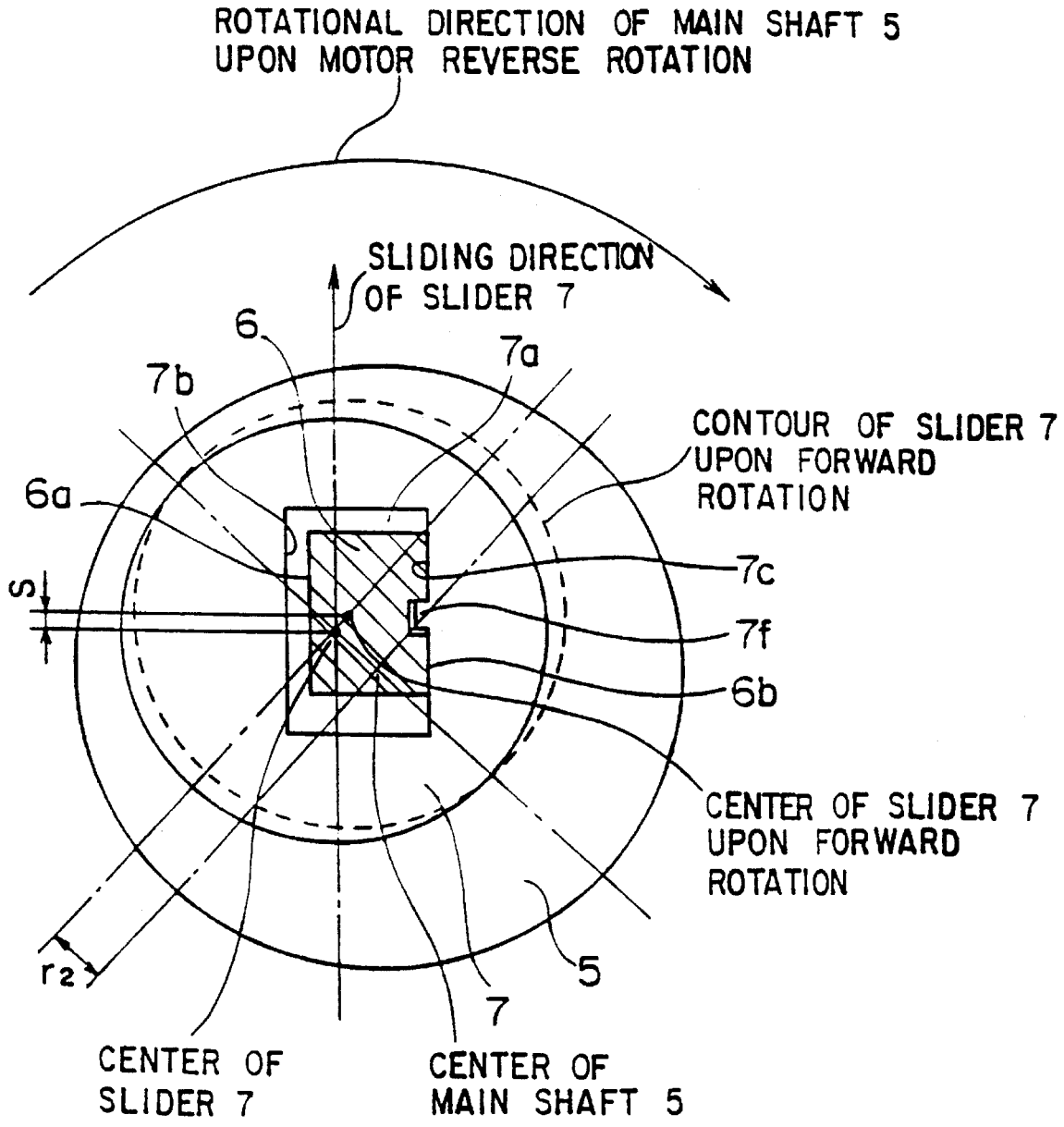
FIG. 14 is a sectional view of a main portion of the scroll-type compressor of the fifth embodiment of the present invention upon the reverse rotation of the motor.

FIG. 10 is a top ;plan view of the slider mounting shaft 6 of the embodiment 6 and FIG. 11 is a top plan view of the slider 7 of this embodiment. Also, FIG. 12 is a sectional view upon the forward rotation and FIGS. 13 and 14 are sectional views of the main portion upon the reverse rotation. In FIG. 10, the flat surface 6*b* has formed therein a groove 6*c*, and a tapered surface 6*d* toward the flat surface 6*b* is provided in the side surface on the sliding direction side. 6*e* is a side surface on the sliding surface side other than the taper surface 6*d* which is referred to a groove side surface.

In FIG. 11, in the opposite sliding surface 7*c* , there is provided a projection 7*f* which has a width smaller than the width of the groove 6*c* , the projection 7*f* may be integral with the slider 7 or a key inserted in the slider. 7*g* is a side surface in the sliding direction of the projection 7*f* , which is referred to as a projection side surface. 7*h* is a corner of the projection 7*f* in the sliding direction, which is referred to as a corner. Also, the slider mounting shaft 6 and the fitting hole 7*a* of the slider 7 define a clearance d having a width larger than the height of the projection 7*f* between the flat surface 6*b* and the opposite sliding surface 7*c* upon the forward rotation as illustrated in FIG. 12, and the flat surface 6*a* and the sliding surface 7*b* are in parallel contact with each other and the inclination angle is a α. Also, in the state in which the eccentricity determined by the configuration of the scrolls, i.e., the eccentricity is $r_1$ and the scroll member of the orbiting scroll 2 is urged against the scroll member of the stationary scroll 1, the projection side surface 7*g* is positioned on the sliding direction side by a distance S from the groove side surface 6*e*, and the projection 7*f* and the groove 6*c* are disposed at a position where a line extending from the projection side surface 7*g* intersects with the tapered surface 6*d*.

The description will now be made in conjunction with FIGS. 13 and 14 as to the state in which the scroll compressor of this embodiment is reversely rotated. Immediately after the main shaft 5 starts to rotate in the reverse direction, the eccentricity is $r_1$ as illustrated in FIG. 13 and the tapered surface 6*d* is first brought into contact with the corner 7*g* of the projection 7*f* . However, since this state is a contact between a taper surface and a corner portion, the position of the slider mounting shaft 6 and the slider 7 is not stable and the corner 7*g* is moved along the tapered surface 6*d* in the direction opposite to the sliding direction due to the rotating torque of the main shaft 5 until the projection 7*f* slips off the tapered surface 6*d* into the groove 6*c* to bring the flat surface 6*b* into contact with the opposite sliding surface 7*c* as illustrated in FIG. 14. Therefore, the slider 7 receeds in the direction opposite to the sliding direction by a distance S to exhibit the eccentricity $r_2$ smaller than $r_1$, thereby generating a radial clearance between the scrolls.

Even when the slider 7 is urged by a force toward the sliding friction, the projection side surface 7*f* engages the groove side surface 6*e*, which serve as a stopper, whereby the slider 7 cannot be moved in the sliding direction further to maintain the radial clearance between two scrolls.

As above described, in embodiment 5, upon the forward rotation, similarly to embodiment 1, the orbiting scroll 2 is urged against the stationary scroll 1 by an appropriate contact force to make the radial clearance between the scrolls zero to achieve the highly efficient compression free from the leakage and, upon the reverse rotation, the movement of the slider 7 into the sliding direction (scroll member urging direction) is limited, whereby the radial clearance between two scrolls is maintained to prevent the generation of vacuum within the compression chamber.

In embodiment 5, the position of the groove 6*c* and the projection 7*f* may be anywhere in the flat surface 6*b* or the opposite contacting surface 7*c* as long as the above-described condition is satisfied. Also, a similar advantageous effect can be obtained when the projection 7*f* is formed on the flat surface 6*b* and the groove 6*c* is formed on the opposite contacting surface 7c and the tapered surface 6d may be formed on the side surface of the opposite sliding direction side.

Also, while the groove 6c and the projection 7f are disposed over the entire height of the flat surface 6b and the opposite contact surface 7c in FIGS. 10 and 11, respectively, they may be partially provided at a desired height with a similar advantageous effect as long as the previously described condition is satisfied.

Embodiment 6

Figure 15:
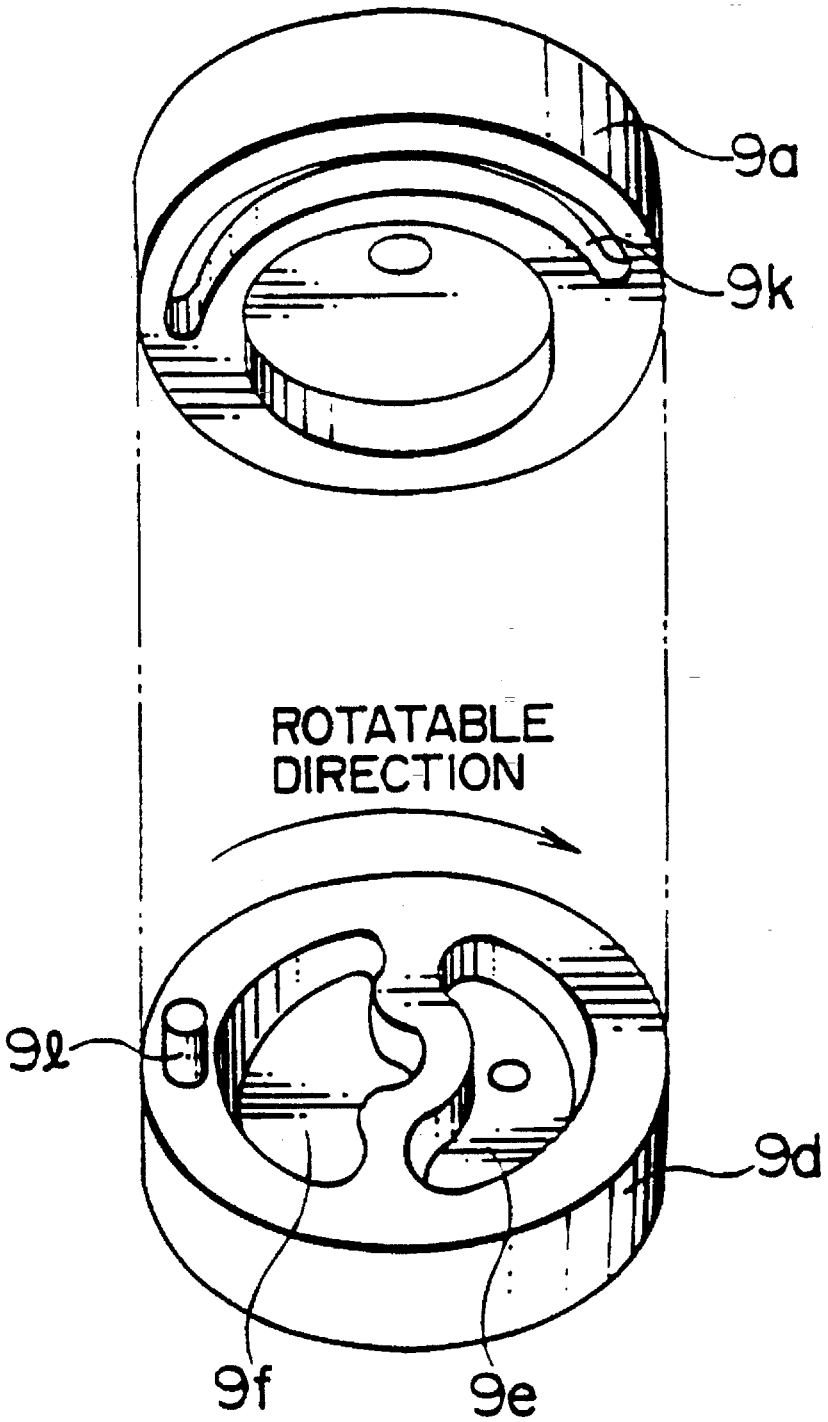
FIG. 15 is a perspective view of main parts constituting the gear pump of the sixth embodiment of the present invention.
Figure 25:
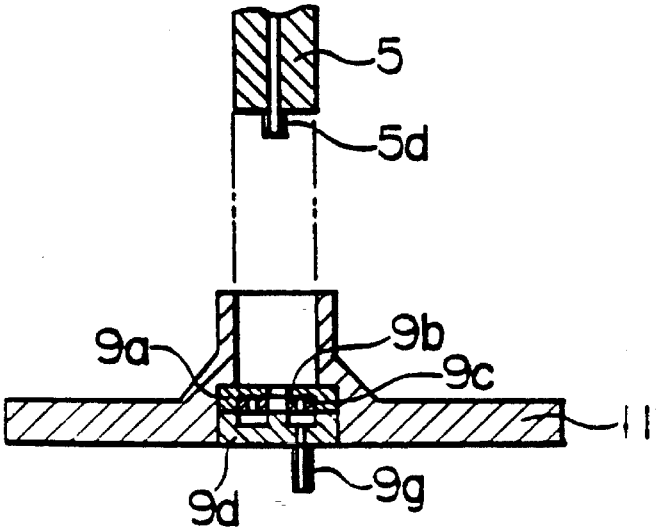
FIG. 25 (PRIOR ART)
FIG. 25 is an exploded view of the pump employed in the conventional scroll-type compressor shown in FIG. 24.
Figure 26:
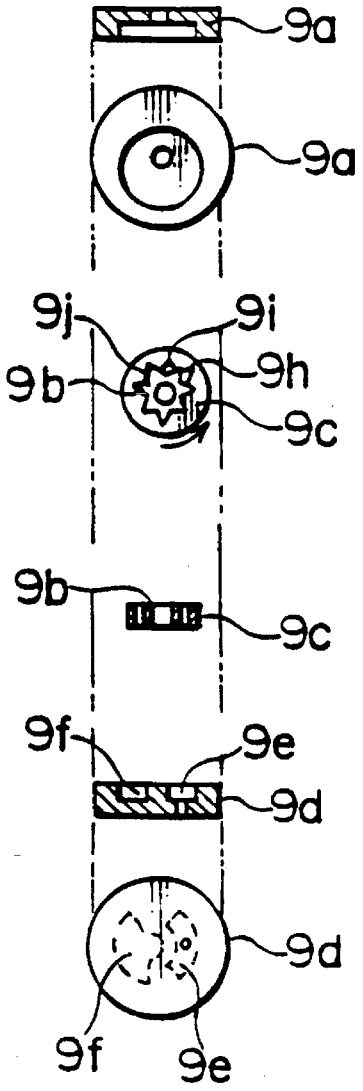
FIG. 26 (PRIOR ART)
FIG. 26 is an exploded detailed parts view of the pump shown in FIG. 25.

FIG. 15 is a perspective view of the pump case 9a and the pump port plate 9d of the scroll-type compressor of embodiment 6 of the present invention. Other parts in connection with the gear pump will not be described because they are identical to those of the conventional design illustrated in FIGS. 25 and 26. The pump port plate 9d is provided with a cylindrical projection portion 9l and the pump case 9a is provided with a 180° ring-shaped groove 9k for engaging the projection portion 9l.

Contrary to the pump port plate 9d which is secured to the subframe 8, the pump case 9a has an top end surface in slidable contact with the bottom end surface of the main shaft 5 and has a bottom end surface in slidable contact with the pump port plate 9d and its outer circumference is accommodated in the subframe 11 with a small clearance therebetween.

Figure 16:
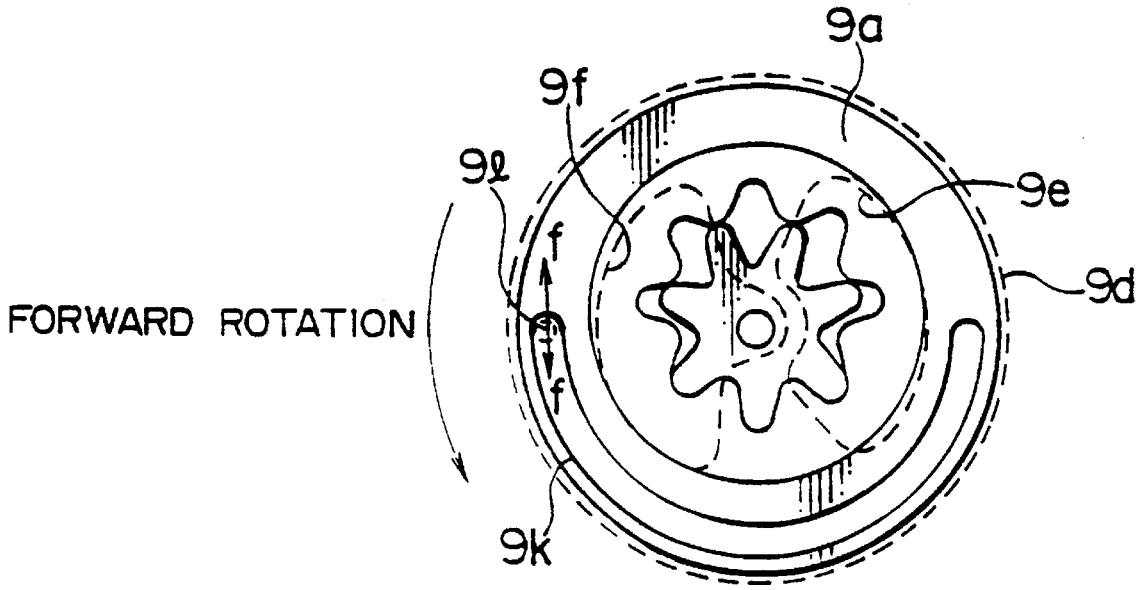
FIG. 16 is a diagram explaining the operation of the gear pump of the sixth embodiment of the present invention upon the forward rotation of the motor.
Figure 24:
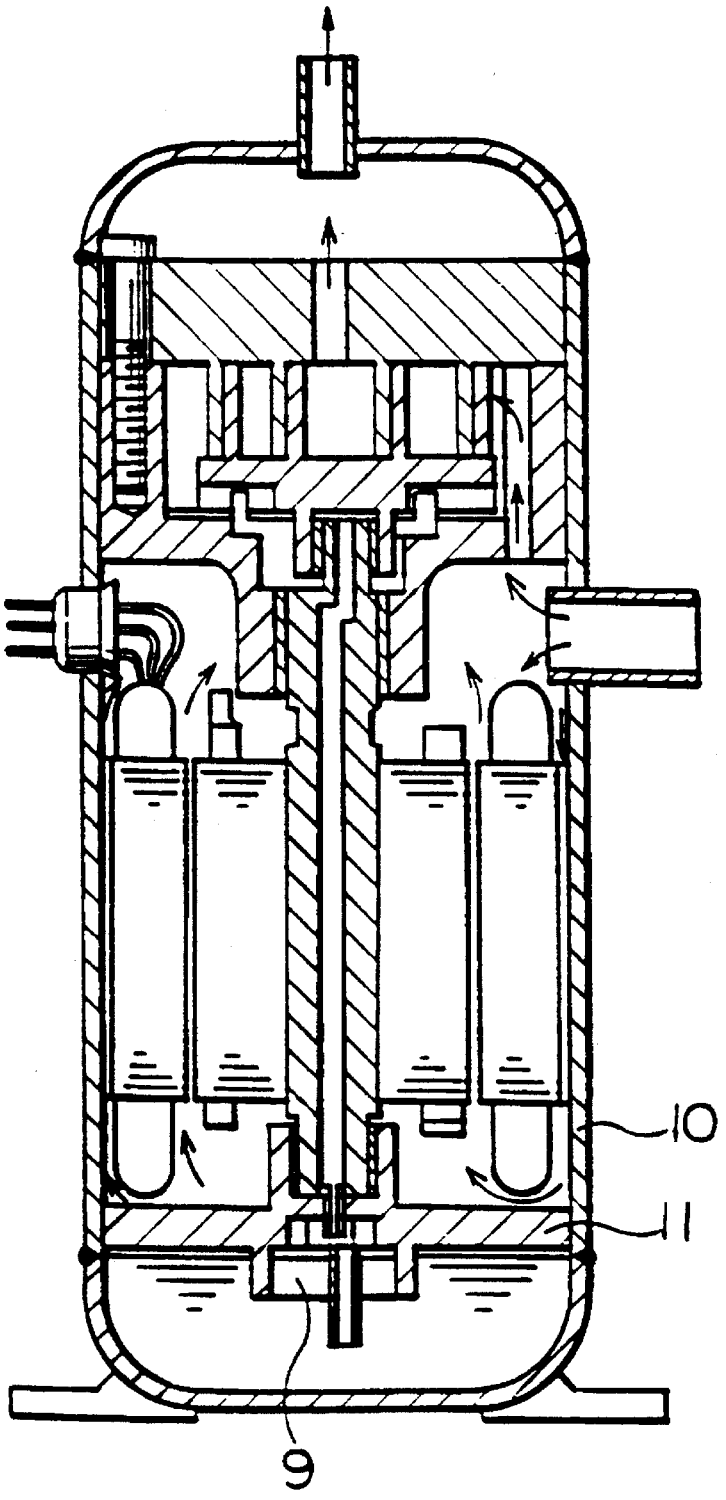
FIG. 24 (PRIOR ART)
FIG. 24 is a longitudinal sectional view of a conventional scroll-type compressor.

FIG. 16 is a view explaining the operation of the gear pump of this embodiment upon the forward rotation of the motor, in which the pump port plate 9d is shown by dashed lines. During the forward rotation (counterclockwise in FIG. 16) of the main shaft 5, the pump case 9a connected to the main shaft 5 is always subjected to a counterclockwise rotating moment due to the frictional force given from the main shaft 5. On the other hand, a pressing force f, which is generated between the projection portion 9l of the pump port plate 9d and the left end of the 180° ring-shaped groove 9k of the pump case 9a, cancels out the previously described, counterclockwise rotating moment. Therefore, the pump case 9a is stable in the position shown in FIG. 16. In such state, the lubricating oil staying at the bottom of the hermetic vessel 10 is supplied to the various sliding portions of the compressor, the mechanism of which are not described here because it is explained in relation to the conventional design associated with FIGS. 24 to 26.

Figure 17:
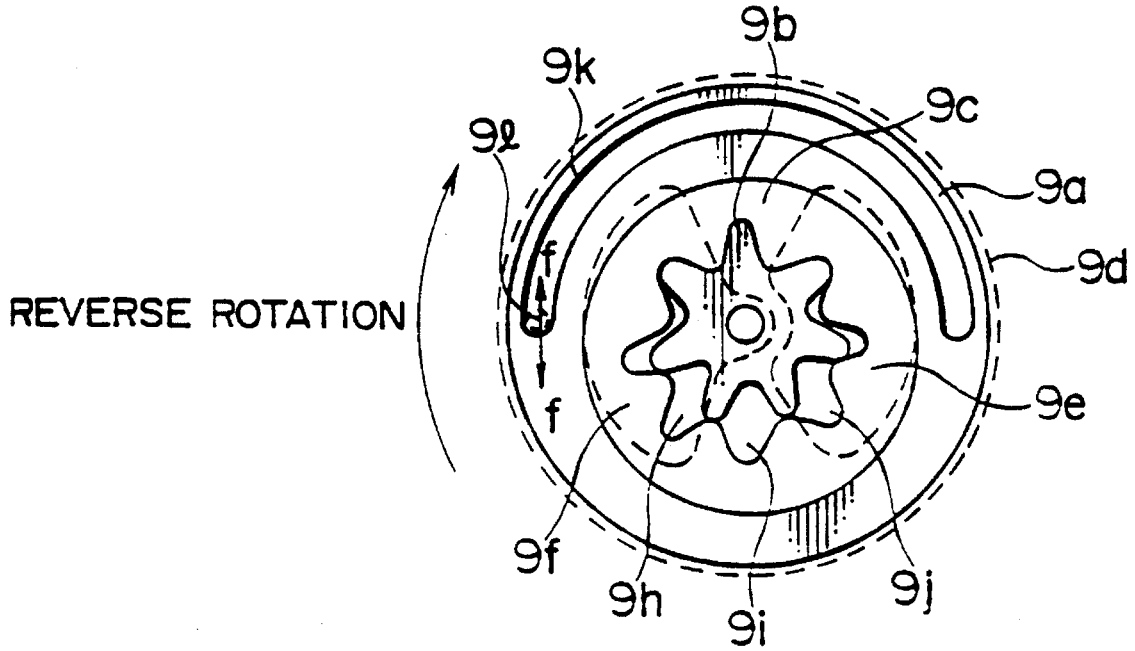
FIG. 17 is a diagram explaining the operation of the gear pump of the sixth embodiment of the present invention upon the reverse rotation of the motor.
Figure 18:
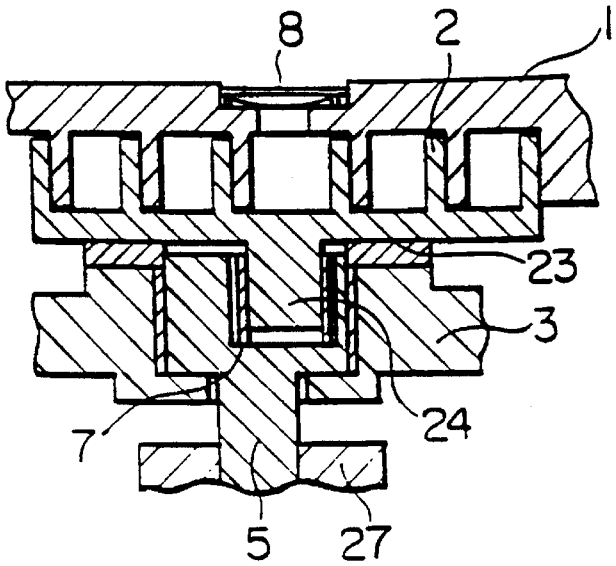
FIG. 18 (PRIOR ART)
FIG. 18 is a sectional view illustrating a conventional scroll-type compressor.

FIG. 17 is a view explaining the operation of the gear pump of this embodiment upon the reverse rotation of the motor, in which the pump port 9d is shown by dotted lines. Upon the reverse (clockwise in FIG. 17) rotation of the main shaft 5, the pump case 9a connected to the main shaft 5 is always subjected to a clockwise rotating moment due to the frictional force from the main shaft 5. Therefore, the pump case 9a is stable at the position shown in FIG. 17, which is rotated by 180° in clockwise direction from the position at the time of the forward rotation shown in FIG. 16. In this state, a force f is generated between the projection portion 9l of the pump port plate 9d and the right end of the 180° ring-shaped groove of the pump case 9a and the previously described clockwise rotational moment is cancelled out.

Since the pump case 9a is positioned in 180° rotated position relative to the position upon the forward rotation, out of three clearance spaces defined between the clearance between the inner gear 9b and the outer gear 9c, the clearance 9j is communicated with the oil suction port 9e and the clearance space 9h is communicated with the oil discharge port 9f. Further, during the reverse rotation, the clearance space 9j increases its volume and the clearance space 9h decreases its volume.

Therefore, the lubricating oil staying at the bottom portion of the hermetic vessel 10 is suctioned through the oil suction pipe 9g and the oil suction port 9e into the clearance space 9j which has an increasing volume. This lubricating oil is then provided to the clearance space 9h which has a decreasing volume through the clearance space 9i. This lubricating oil is further supplied to the various sliding portions of the compressor through oil bore formed at the center of the main shaft 5 after it is discharged in the oil discharged port 9f because the volume of the clearance space 9h is decreasing.

APPLICABILITY IN INDUSTRY

As has been described, according to the scroll-type compressor of the present invention, since the sliding surface of the slider is arranged to have an angle so that the slider is moved therealong in the direction in which the revolution radius of the orbiting scroll of the compressor is decreased, a clearance is generated between the stationary scroll and the orbiting scroll upon the reverse rotation. Therefore, an advantageous effect can be obtained in which a vacuum state within the compression chamber is prevented and no damages occur in the tip of the stationary scroll and the orbiting scroll.

Also according to the scroll-type compressor of the present invention, the clearance defined between the slider mounting shaft and the fitting hole of the slider is arranged so that the slider is moved in the direction in which the eccentricity of the orbiting scroll decreases upon the reverse rotation of the motor. Therefore, when the compressor is rotated in the forward direction, a highly efficient compression function without leakage can be realized by the urging of the orbiting scroll to the stationary scroll at an appropriate contact force and, when the motor is erroneously rotated in the reverse direction, the slider is moved in the direction in which eccentricity of the orbiting scroll decreases, so that a radial clearance is generated between the scrolls to enable the vacuum state therein to be relieved, whereby an advantageous effect can be obtained in which a highly efficient and reliable scroll-type compressor free from the damages in the tips of the stationary scroll and the orbiting scroll can be provided.

According to another scroll-type compressor of the present invention, the configuration of the slider and the slider mounting shaft or the main shaft can be made in such configuration that the slider cannot be assembled on the slider mounting shaft when it is rotated by 180°, so that the slider cannot be mounted to the slider mounting shaft when it is rotated by 180° and, when the compressor is rotated in the forward direction, a highly efficient compression function without leakage can be realized by the urging of the orbiting scroll to the stationary scroll at an appropriate contact force and, when the motor is erroneously rotated in the reverse direction, the slider is moved in the direction in which eccentricity of the orbiting scroll decreases, so that a radial clearance is generated between the scrolls to enable the vacuum state therein to be relieved, whereby an advantageous effect can be obtained in which a highly efficient and reliable scroll-type compressor free from the damages in the tips of the stationary scroll and the orbiting scroll can be provided.

In another scroll-type compressor of the present invention, the angle of the sliding surface of the slider and the slider mounting shaft is selected so that the slider is moved in the direction in which the eccentricity of the orbiting scroll decreases upon the reverse rotation of the motor, so that, when the compressor is rotated in the forward direction, a highly efficient compression function without leakage can be realized by the urging of the orbiting scroll to the stationary scroll at an appropriate contact force and, when the motor is erroneously rotated in the reverse direction, the slider is moved in the direction in which eccentricity of the orbiting scroll decreases, so that a radial clearance is generated between the scrolls to enable the vacuum state therein to be relieved, whereby an advantageous effect can be obtained in which a highly efficient and reliable scroll-type compressor free from the damages in the tips of the stationary scroll and the orbiting scroll can be provided.

According to the scroll-type compressor of the present invention, a stopper mechanism for restricting the sliding movement of the slider upon the reverse rotation of the motor is mounted to the slider and the slider mounting shaft, so that, when the compressor is rotated in the forward direction, a highly efficient compression function without leakage can be realized by the urging of the orbiting scroll to the stationary scroll at an appropriate contact force and, when the motor is erroneously rotated in the reverse direction, the slider movement is restricted by the stopper against the force urging the slider into the sliding direction, so that a radial clearance is maintained between the scrolls and free from the vacuum state, whereby an advantageous effect can be obtained in which a highly efficient and reliable scroll-type compressor free from the damages in the tips of the stationary scroll and the orbiting scroll can be provided.

In another scroll-type compressor of the present invention, the arrangement is such that the pump case alone rotates by 180° upon the reverse rotation of the motor, so that the lubricating oil staying at the bottom of the hermetic vessel can be ensured to be supplied by the gear pump to each sliding portion of the compressor, whereby a highly efficient and reliable compressor can advantageously be obtained.

We claim:

1. A scroll-type compressor comprising:

a stationary scroll and an orbiting scroll, each of said stationary scroll and said orbiting scroll having base plates from which scroll portions project;

a compression chamber defined between said stationary scroll and said orbiting scroll when said stationary scroll and said orbiting scroll are combined in an eccentric: position shifted in phase by 180°;

an orbiting bearing disposed on said orbiting scroll on a side of said orbiting scroll which is opposite to said compression chamber;

a main shaft for transmitting a drive force to the orbiting scroll;

a slider mounting shaft mounted at one end of said main shaft and having a first flat surface and a second flat surface;

a slider fitted on said orbiting bearing and including a slider fitting hole having a first sliding surface and a second sliding surface for receiving said slider mounting shaft therein, said slider being non-rotatable and slidable relative to said slider mounting shaft in a plane perpendicular to an axis of said main shaft; and means for defining a clearance between said second flat surface of said slider mounting shaft and said second sliding surface of said slider upon a forward rotation of said main shaft, said clearance allowing, upon a reverse rotation of said main shaft, said second flat surface of said slider mounting shaft and said second sliding surface of said slider to be brought into contact with each other, and said clearance allowing said slider to shift in a direction in which an amount of eccentricity of said orbiting scroll decreases to generate a radial clearance between said stationary scroll and said orbiting scroll.

2. A scroll-type compressor as claimed in claim 1, wherein a configuration of said slider and said slider mounting shaft or said main shaft prevents said slider from being assembled on said slider mounting shaft when the slider mounting shaft is rotated by 180°.

3. A scroll-type compressor as claimed in claim 1, wherein said fitting hole comprises a portion at said clearance which has a width that is smaller than a width of said first flat surface of said slider mounting shaft.

4. A scroll-type compressor as claimed in claim 1, wherein:

a top end surface of the main shaft comprises a projection; and a bottom end surface of said slider comprises a recess such that the projection of the main shaft is fitted in the recess of the slider when the slider is mounted on the main shaft.

* * * * *